US011873135B2

(12) United States Patent
Hendrik Van Ee

(10) Patent No.: US 11,873,135 B2
(45) Date of Patent: Jan. 16, 2024

(54) FITTED GIGACUBES

(71) Applicant: Jonathan Hendrik Van Ee, Dublin, CA (US)

(72) Inventor: Jonathan Hendrik Van Ee, Dublin, CA (US)

( * ) Notice: Subject to any disclaimer, the term of this patent is extended or adjusted under 35 U.S.C. 154(b) by 204 days.

(21) Appl. No.: 17/305,449

(22) Filed: Jul. 7, 2021

(65) Prior Publication Data

US 2022/0041331 A1 Feb. 10, 2022

Related U.S. Application Data

(60) Provisional application No. 62/706,236, filed on Aug. 6, 2020.

(51) Int. Cl.

| | |
|---|---|
| ***A63H 33/08*** | (2006.01) |
| ***B65D 21/02*** | (2006.01) |
| ***A45C 11/00*** | (2006.01) |
| ***A63H 33/04*** | (2006.01) |

(52) U.S. Cl.

CPC ..... *B65D 21/0209* (2013.01); *A45C 11/00* (2013.01); *A63H 33/04* (2013.01); *B65D 21/0233* (2013.01); *A45C 2011/002* (2013.01)

(58) Field of Classification Search

CPC ..... B65D 21/0209–04; A63H 33/08–108

See application file for complete search history.

(56) References Cited

U.S. PATENT DOCUMENTS

| | | | | | |
|---|---|---|---|---|---|
| 243,362 | A * | 6/1881 | Crandall | G09B 17/00 | 446/69 |
| 269,789 | A * | 12/1882 | Jaeger | A63H 33/105 | 273/156 |
| 595,455 | A * | 12/1897 | Glidden | G09B 23/04 | 273/157 R |
| 1,236,896 | A * | 8/1917 | Anderson | A63J 19/00 | 446/124 |
| 1,328,921 | A * | 1/1920 | Howe | A63H 3/52 | 446/482 |
| 1,330,780 | A * | 2/1920 | Bonte | G09F 1/08 | 220/DIG. 13 |
| 1,655,662 | A * | 1/1928 | Repay | A63H 33/06 | 403/345 |
| 1,660,119 | A * | 2/1928 | Decker | A47C 13/00 | 446/482 |

(Continued)

*Primary Examiner* — Eugene L Kim
*Assistant Examiner* — Matthew B Stanczak

(57) ABSTRACT

The Invention is a collection of snap, knob and other interfaces on basic shapes comprised of cubes, boxes and cups (cylinders) that fit together in versatile ways to empower builders with compact pieces. The basic shapes can fit into themselves a variety of different ways to make their constructions stronger, to make them store in a more compact and strong manner, or to occupy more space or hold food or liquids. The snaps, knobs and hooks, and the basic shapes of the pieces themselves, are all designed to maximize versatile utility that can be made with flexible pieces (like rubber or flexible plastic), rigid materials (like ceramics, cast iron or glass), and combinations of flexible and rigid materials. The combinations can also be made at different strengths because the hardness of the interfaces can be adjusted to have a secure fit, a loose fit, or a moderately strong fit.

1 Claim, 39 Drawing Sheets

(56) References Cited

U.S. PATENT DOCUMENTS 1,894,061 A * 1/1933 Sanders ..... A63H 33/084 D21/491
2,057,942 A * 10/1936 Aurele ..... A63H 33/108 446/112
2,124,352 A * 7/1938 Patten ..... A63H 3/52 446/69
2,131,349 A * 9/1938 Kreider, Jr. ..... A63H 33/10 229/122.34
2,412,325 A * 12/1946 Devine ..... B65D 43/022 206/508
2,429,958 A * 10/1947 Liebmann ..... B65D 21/0217 206/520
2,695,115 A * 11/1954 Roop ..... B65D 21/0219 206/508
2,777,597 A * 1/1957 Ruff ..... B25H 3/02 206/509
2,799,969 A * 7/1957 Henrickson ..... A63H 33/00 446/451
2,814,159 A * 11/1957 Green ..... A63H 33/06 446/69
2,936,544 A * 5/1960 Fay ..... A63H 33/084 446/124
2,978,142 A * 4/1961 Novick ..... B65D 21/0219 206/508
3,182,856 A * 5/1965 Goltz ..... B65D 21/0213 220/4.27
3,221,439 A * 12/1965 Schaper ..... F16B 7/04 403/345
3,331,529 A * 7/1967 Slapnik ..... B65D 21/0213 206/508
3,371,816 A * 3/1968 Ricci ..... B65D 11/1873 220/4.28
3,376,046 A * 4/1968 Kivett ..... B62B 1/10 206/508
3,412,502 A * 11/1968 Riches ..... A63H 33/08 446/124
3,670,449 A * 6/1972 Lemkin ..... A63H 33/088 446/124
3,701,214 A * 10/1972 Sakamoto ..... A63H 33/082 446/116
3,708,910 A * 1/1973 Skillman ..... A63H 33/088 446/117
3,780,469 A * 12/1973 Hancovsky ..... A63H 33/065 297/118
3,924,376 A * 12/1975 Tsurumi ..... A63H 33/084 40/107
4,037,354 A * 7/1977 ChaBakKuk ..... A63H 33/001 428/542.2
4,055,019 A * 10/1977 Harvey ..... A63H 33/065 446/124
4,253,266 A * 3/1981 Bajo ..... A63H 37/00 446/69
5,392,945 A * 2/1995 Syrek ..... B65D 21/0235 206/508
5,746,038 A * 5/1998 Houk ..... E04B 1/02 446/116
5,782,667 A * 7/1998 Luby ..... A63F 9/1288 446/85
5,853,313 A * 12/1998 Zheng ..... A63H 33/065 446/107
5,860,650 A * 1/1999 Scobbie ..... A63F 9/088 273/157 R
5,895,045 A * 4/1999 Vilar ..... A63H 33/06 446/488
5,954,562 A * 9/1999 Chen ..... A63H 33/10 446/122
6,752,678 B1 * 6/2004 Chuang ..... A63F 9/12 273/157 R
6,782,672 B2 * 8/2004 Staats ..... B32B 3/02 52/272
7,749,042 B2 * 7/2010 Fulgenzi ..... A63H 33/06 446/124
9,108,764 B2 * 8/2015 Gegembauer ..... B65D 21/02
10,188,961 B1 * 1/2019 Lee ..... A63H 33/084
11,359,363 B1 * 6/2022 Brotherton ..... E04B 1/02
2009/0205997 A1 * 8/2009 Richards ..... A63H 33/108 206/579
2010/0194039 A1 * 8/2010 Thrush ..... A63H 33/084 273/153 R
2021/0101739 A1 * 4/2021 Akahoshi ..... B65D 21/0223
2021/0122521 A1 * 4/2021 Li ..... B65D 7/26
2021/0284426 A1 * 9/2021 Kalajyan ..... B65D 81/3813
2021/0317857 A1 * 10/2021 Yokozeki ..... F16B 12/12
2022/0089324 A1 * 3/2022 Whitta ..... B65D 25/282
2022/0242613 A1 * 8/2022 Holzleithner ..... B65D 21/0235
2022/0281638 A1 * 9/2022 Kovatch ..... A47J 47/16
2022/0295783 A1 * 9/2022 Maples ..... B65B 7/2878
2023/0149827 A1 * 5/2023 Engelhard ..... A63H 33/062 446/109
2023/0166197 A1 * 6/2023 Engelhard ..... A63H 33/086 446/109

* cited by examiner

Fig. 28
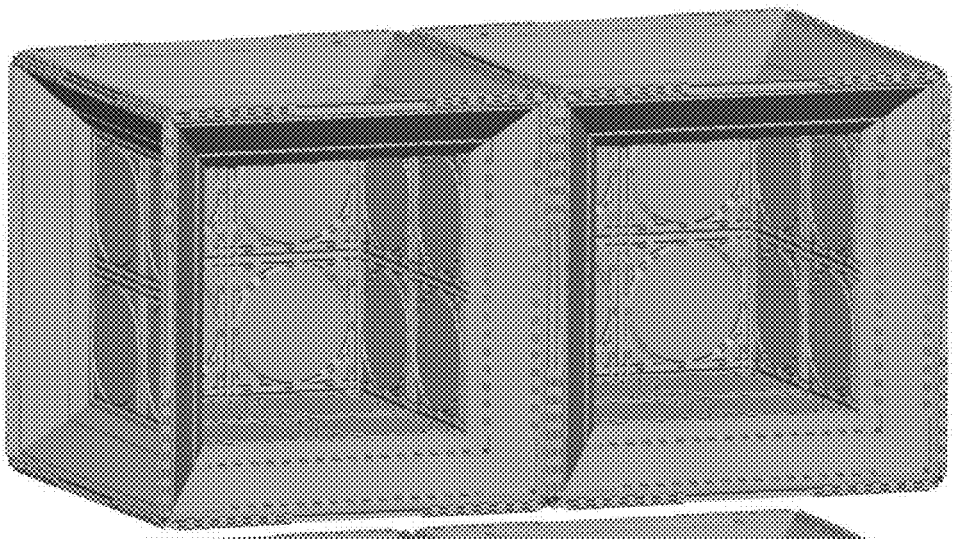
Fig. 29
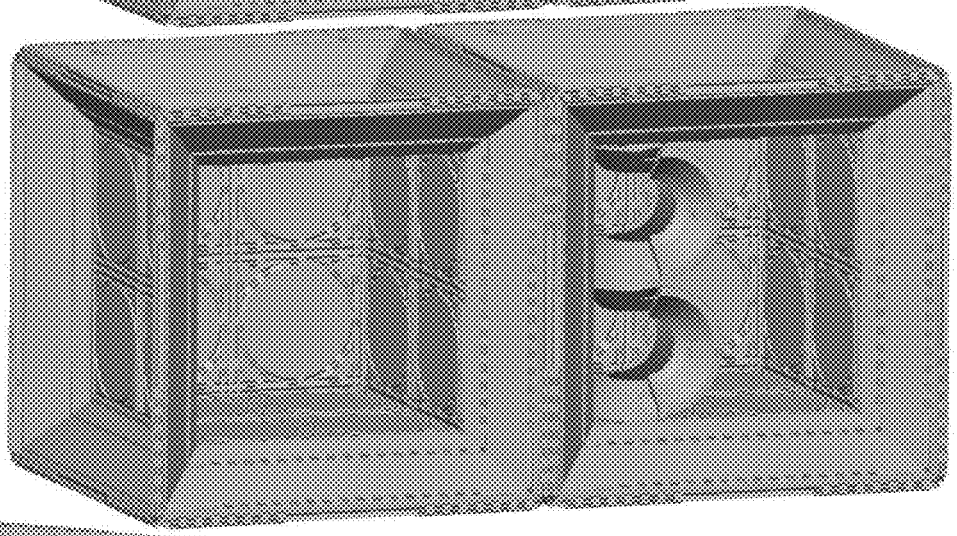
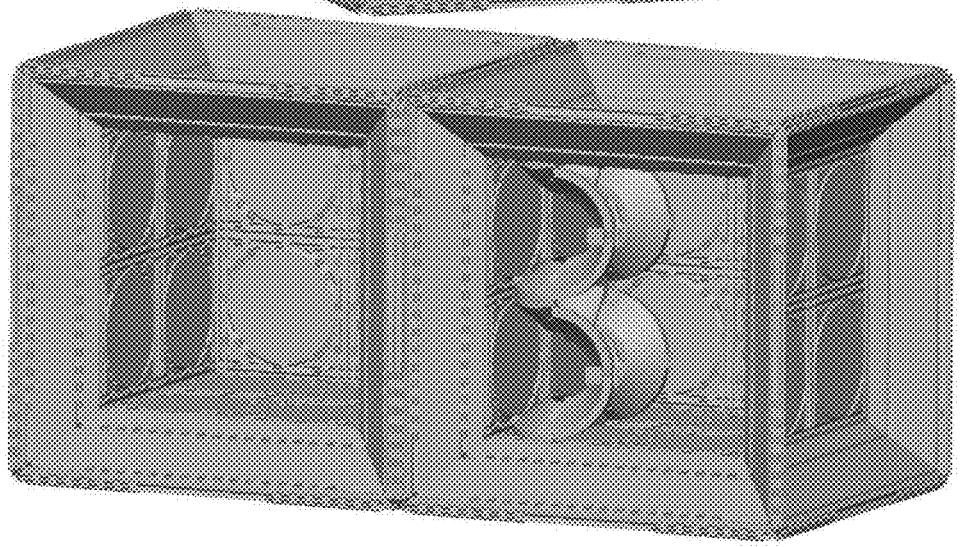
Fig. 30

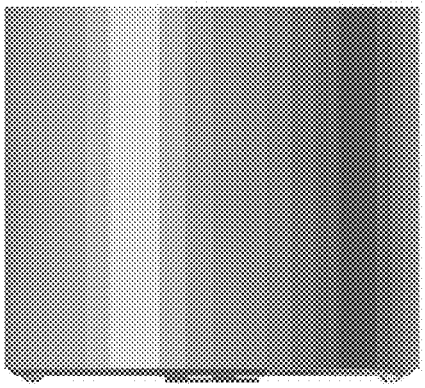
Fig. 55C
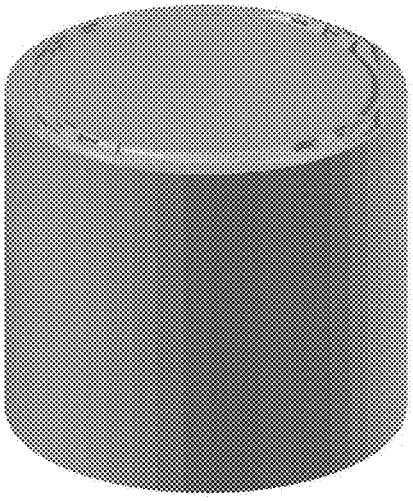
Fig. 55D
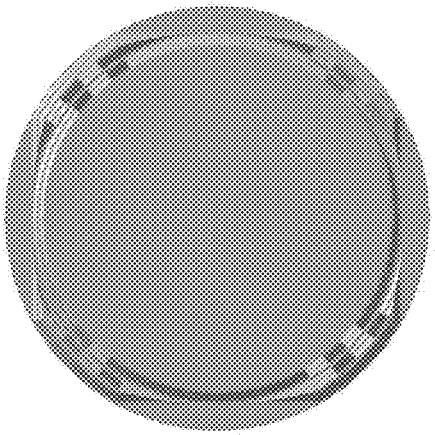
Fig. 55E
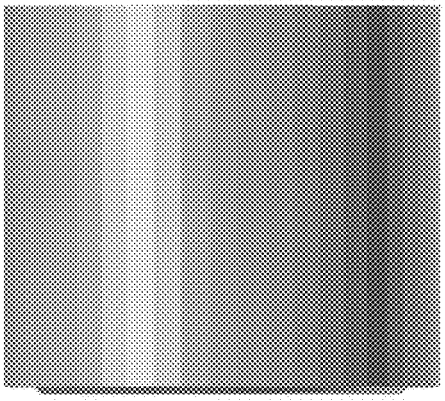
Fig. 56A
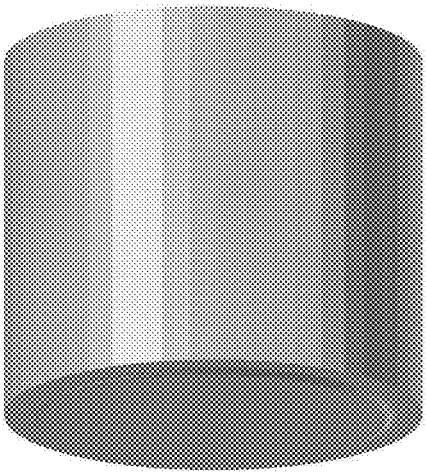
Fig. 56C
Fig. 56B
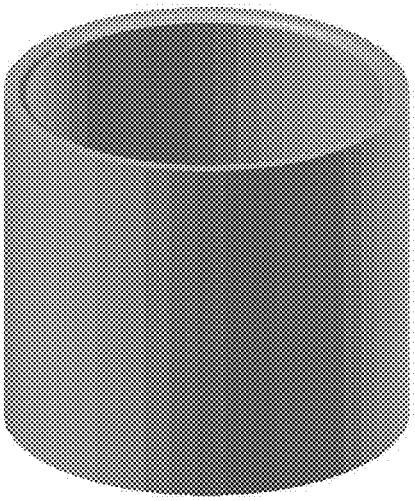

FITTED GIGACUBES

BACKGROUND OF THE INVENTION

Field of the Invention

Fitted Gigacubes (the "Invention") are boxes that fit into themselves several different ways to build structures, to save space (like burger boxes), to seal themselves shut and to be toys while interfacing with snaps, hooks, locks and by simply being stacked or squeezed together.

Description of Related Art

Burger boxes and coffee cups are fitted objects that stack to save significant space.

Bento boxes and cylinders can be stacked to occupy vertical space.

BRIEF SUMMARY OF THE INVENTION

Building blocks that give the user a wide range of options for usable compact objects that save space by fitting into themselves.

Empower builders to snap, hook and lock structures together without using significant material in the building process.

Provide the user with versatile containers that hold food, liquids, and objects so they can be transported with ease or stored in a pantry or refrigerator.

BRIEF DESCRIPTION OF THE SEVERAL VIEWS OF THE DRAWINGS

FIG. 1A can also be built with rigid materials (like ceramics, glass, cast iron, etc.) except that its "s" snaps cannot have protruding male bulges when interfacing with other FIG. 1A pieces that are made of rigid materials.

FIG. 25A is a view inside the box.

FIG. 28 is the other side of the boxes that are assembled in FIG. 27. These boxes form shelves when snapped together in this manner.

FIG. 29 is a demonstration of how FIG. 1A, when snapped to itself two times in the manner shown, can go inside the construction at FIG. 28 to reinforce it in the manner shown in FIG. 29.

FIG. 30 is a different view of the construction at FIG. 29.

FIGS. 41A through 41D are different views of the same object.

FIG. 44 can therefore also fit into FIG. 12A and it can fit into itself and into FIG. 41A.

FIGS. 45A, B and C are different views of the same object.

FIG. 55B is a view of the top of the cup that is FIG. 55A.

FIG. 55C is a profile view from the side of FIG. 55B.

FIG. 55D is another view of the bottom of FIG. 55B.

FIG. 55E is a profile view of the bottom of FIG. 55B.

FIG. 56A is a side profile view of FIG. 56B.

FIG. 56B is the same as FIG. 55B except it is simpler in that it does not have "s" snaps on its bottom.

FIG. 56C is a view from the side bottom of FIG. 56B.

FIG. 57A is a profile view of FIG. 57C.

FIG. 57B is a view of the bottom of FIG. 57C.

FIG. 57C is the same as FIG. 55B except it is half as tall.

FIG. 58A is a profile view from the side of FIG. 58B.

Figure 58A:
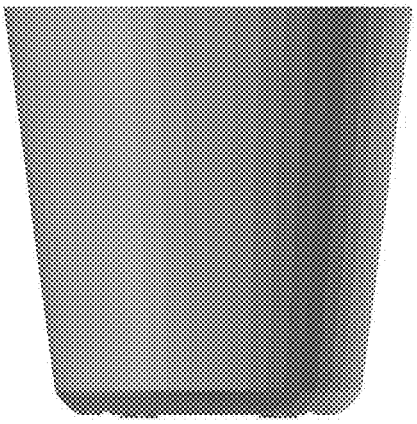
Figure 58B:
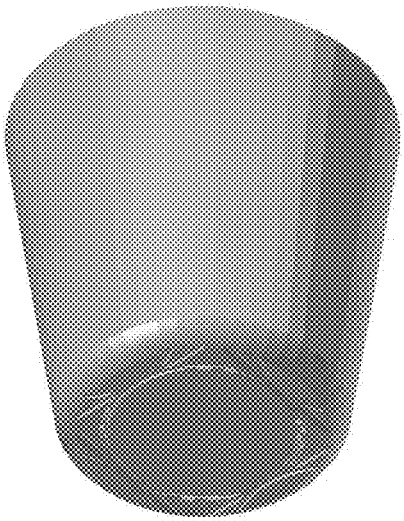

FIG. 58B fits into circular "s" snaps and stacks onto itself like a paper cup for drinking water.

Figure 58C:
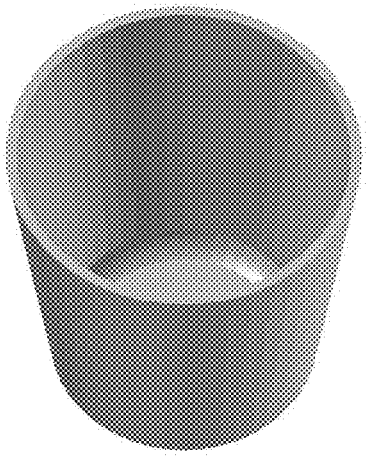

FIG. 58C is a view from a top side of FIG. 58B.

Figure 59A:
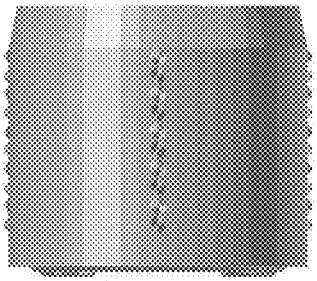
Figure 59B:
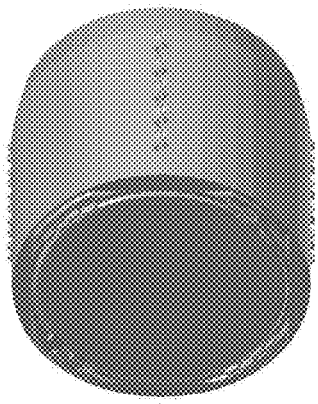
Figure 59C:
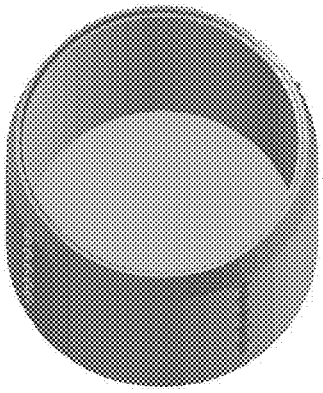

FIG. 59A is a profile view of FIG. 59C from the side.

FIG. 59B is a view from the bottom of FIG. 59C.

Figure 55A:
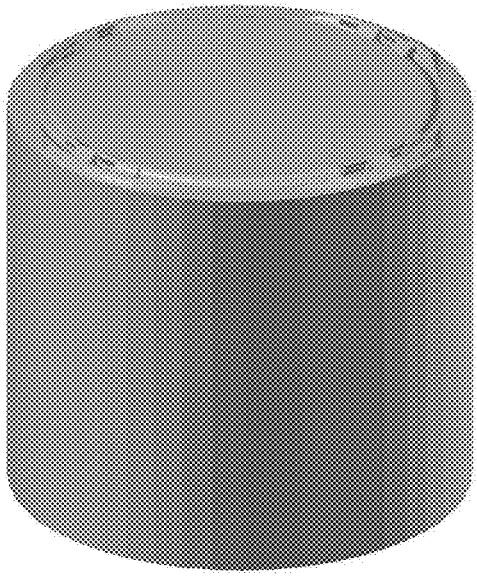
FIG. 55A is a cylinder that also forms a cup holding water. It has "s" snaps on its bottom as shown in FIG. 55A.
Figure 55B:
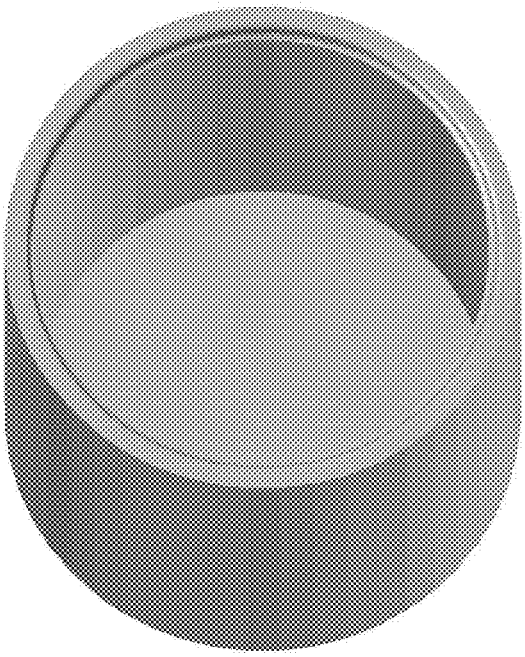

FIG. 59C is like FIG. 55B except it also has "s" snaps on its sides so it can affix itself to itself horizontally.

Figure 59D:
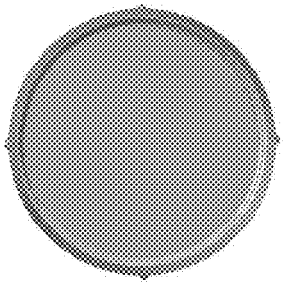

FIG. 59D is a profile view from the top of FIG. 59C.

Figure 60A:
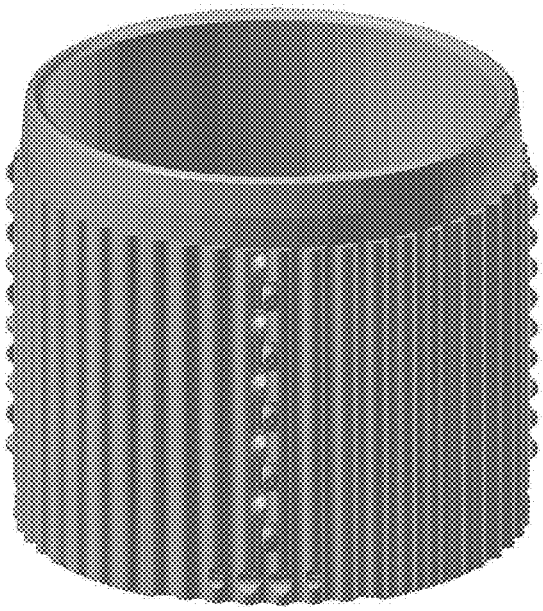

FIG. 60A is the same as FIG. 59C except that it has move indentations that give it more versatility to fit inside constructions that have lots of "s" snaps.

Figure 60B:
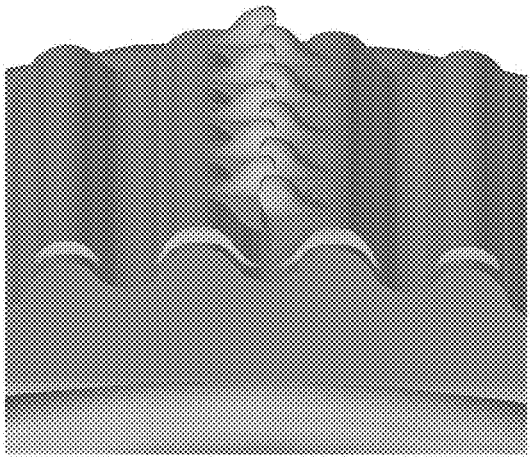

FIG. 60B is a close-up view of the side of FIG. 60A.

Figure 61A:
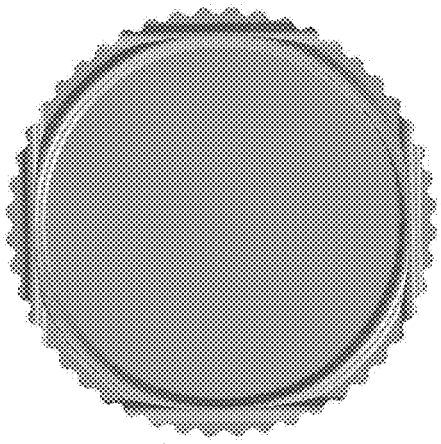
Figure 61B:
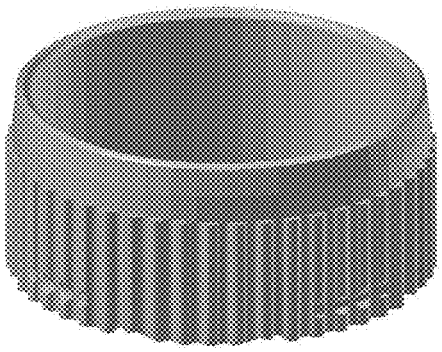

FIG. 61A is a profile view of the bottom of FIG. 61B.

Figure 57A:
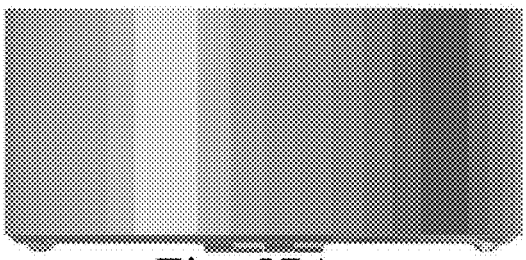
Figure 57B:
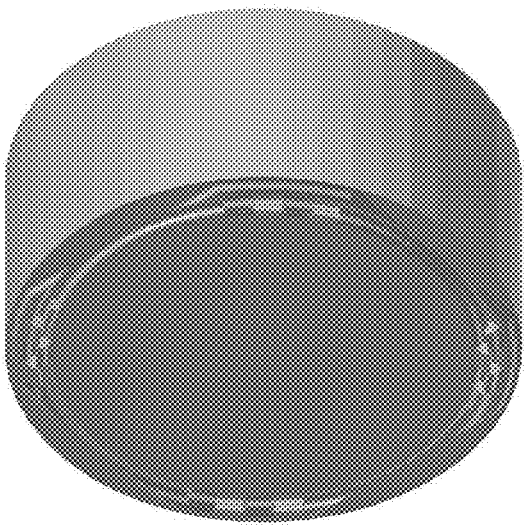
Figure 57C:
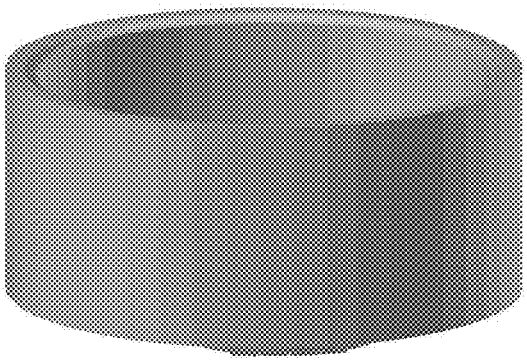

FIG. 61B is a simpler version of FIG. 57C that does not include the "s" snaps.

Figure 61C:
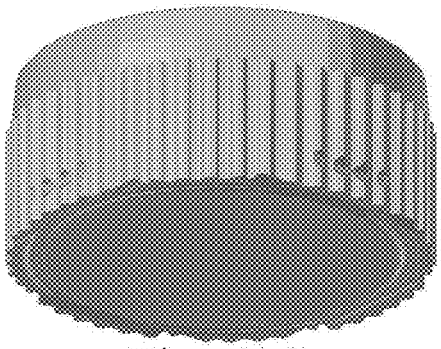

FIG. 61C is a view of the bottom of FIG. 61B.

Figure 62A:
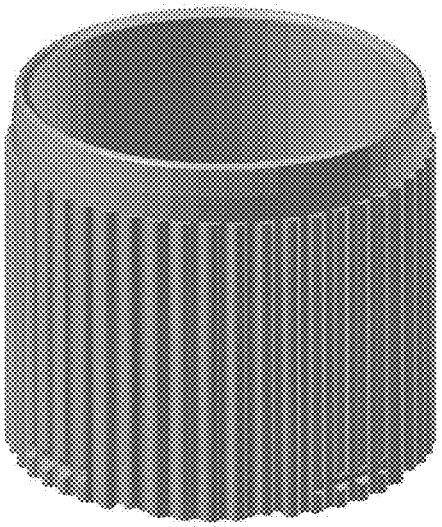

FIG. 62A is a simpler version of FIG. 60A that does not include the "s" snaps.

Figure 62B:
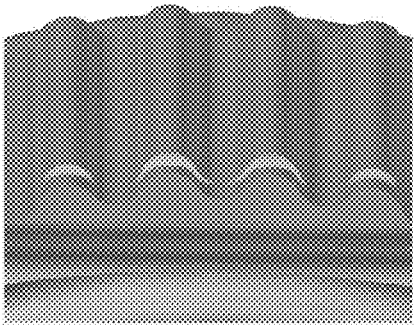

FIG. 62B is a close-up view of the side of FIG. 62A.

Figure 63A:
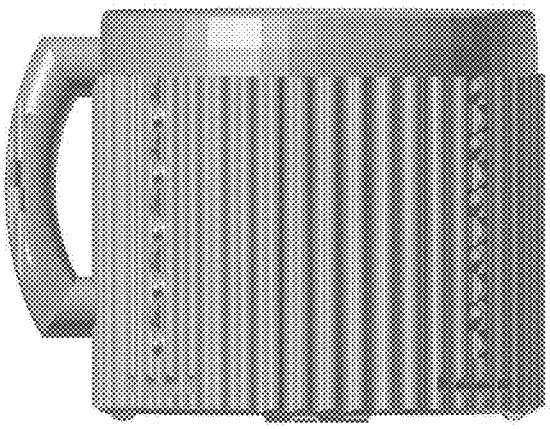
Figure 63B:
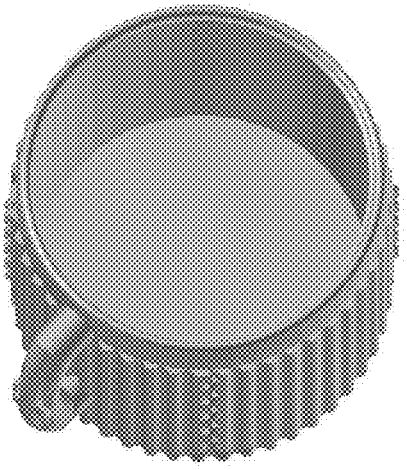

FIG. 63A is a side profile view of FIG. 63B.

FIG. 63B is a cup similar to FIG. 60A except that FIG. 63B has a handle that also has "s" snaps on it.

Figure 63C:
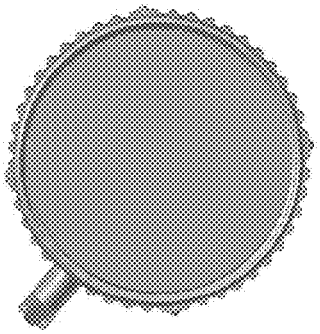

FIG. 63C is a top profile view of FIG. 63B.

Figure 64A:
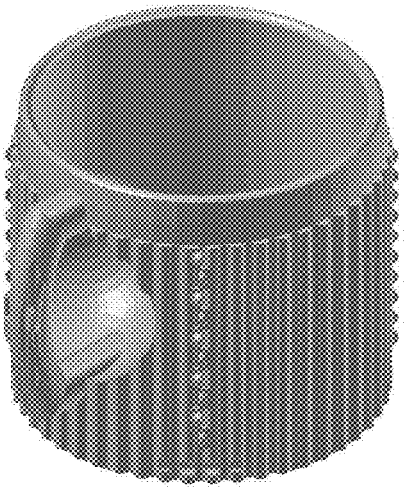

FIG. 64A is the same as FIG. 63B except that it has an indentation on the side by the handle that makes it easier for a person to insert their fingers to hold the handle.

Figure 64B:
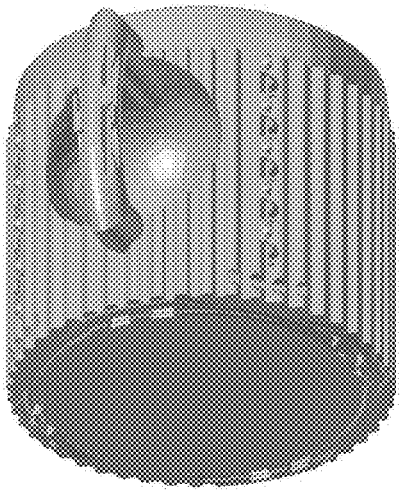

FIG. 64B is a view of the bottom of FIG. 64A.

Figure 64C:
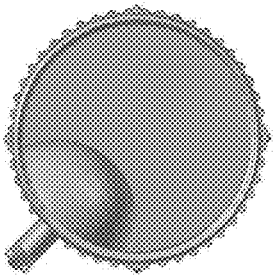

FIG. 64C is a profile view of the top of FIG. 64A.

Figure 64D:
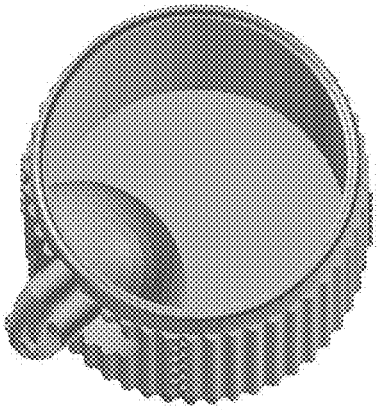

FIG. 64D is a view from the top of FIG. 64A.

Figure 65A:
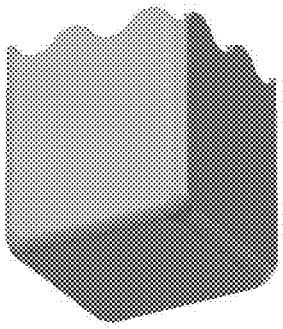
Figure 65B:
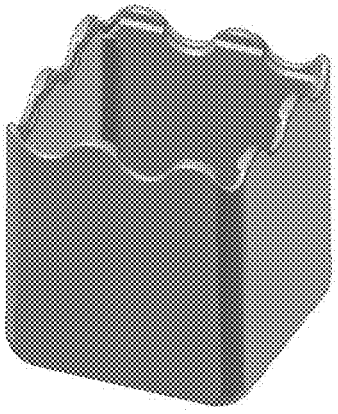

FIG. 65A is a view of the bottom of FIG. 65B.

FIG. 65B is a box with a wavy top that fits into itself to form a larger box that is twice as tall as it is wide and deep.

Figure 65C:
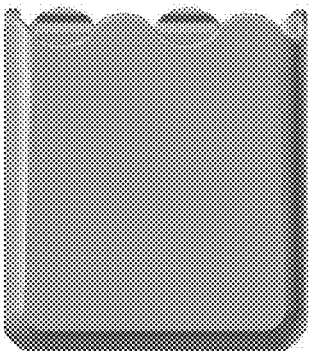

FIG. 65C is a profile view from the side of FIG. 65B.

Figure 66A:
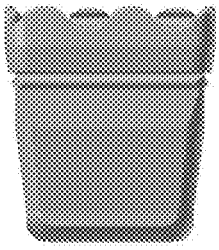
Figure 66B:
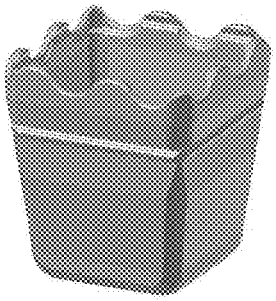

FIG. 66A is a profile view from the side of FIG. 66B.

FIG. 66B is a fitted version of the box at FIG. 65B, meaning the box at FIG. 66B can slide into itself and stack itself that way.

Figure 66C:
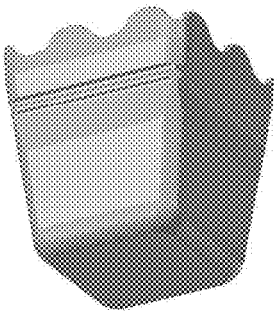

FIG. 66C is a view of the bottom of FIG. 66B.

Figure 67A:
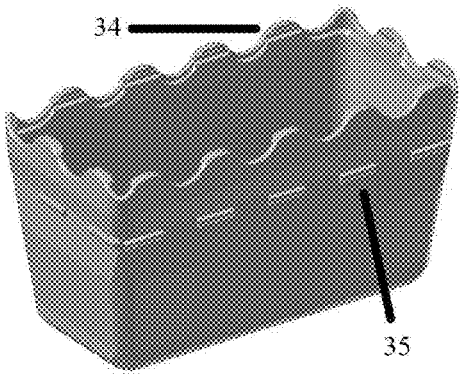

FIG. 67A is a box similar to FIG. 66B except that the box at FIG. 67A is twice as long as it is deep and tall.

Figure 67B:
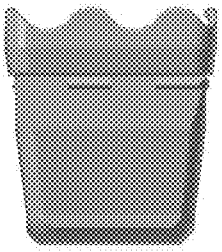

FIG. 67B is a profile view of an end of FIG. 67A.

Figure 67C:
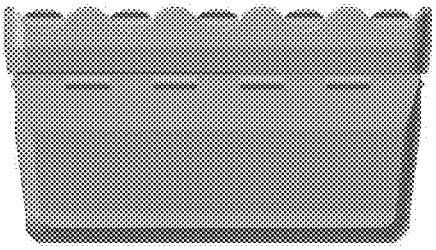

FIG. 67C is a view of the side of FIG. 67A.

Figure 67D:
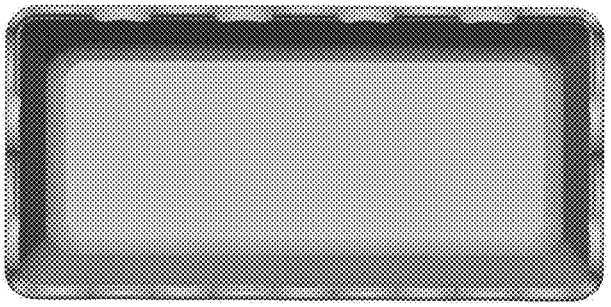

FIG. 67D is a view from the top of FIG. 67A.

Figure 68A:
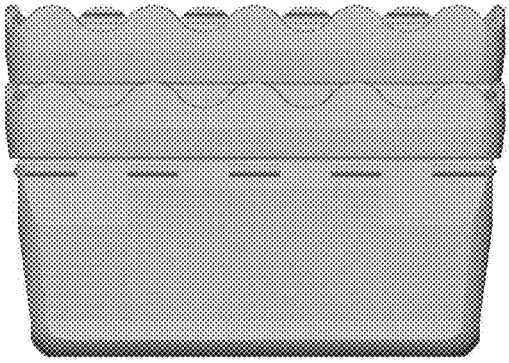

FIG. 68A is a demonstration of how FIG. 67A snaps into itself when stacked.

Figure 68B:
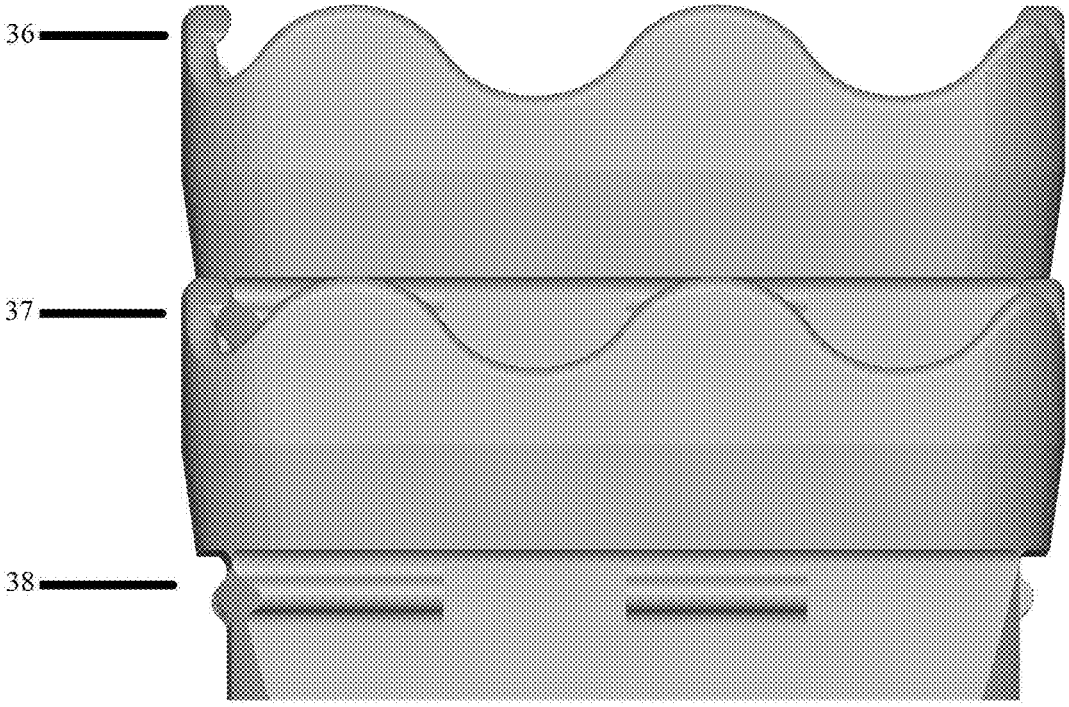

FIG. 68B is a close-up view of a short side of FIG. 68A.

Element 38 is a profile view of the male snap with nothing snapped onto it.

Figure 69:
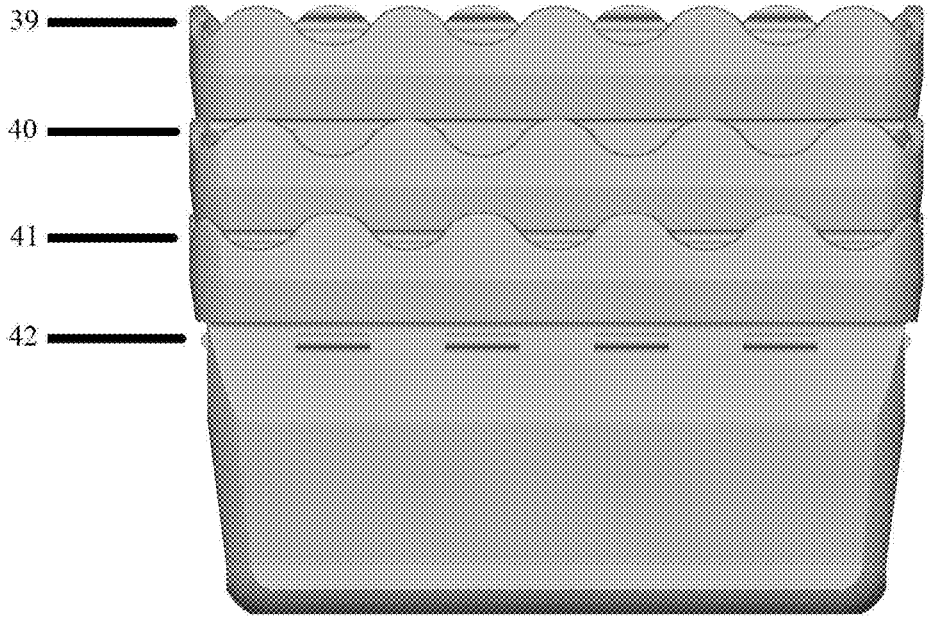

FIG. 69 is a profile view of FIG. 67A stacked in a fitted snapped, and unsnapped, position. At element 39 there is a female snap not snapped onto another box.

Figure 70A:
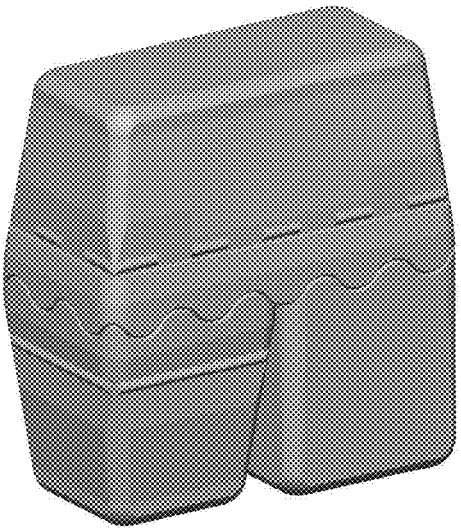

FIG. 70A shows how the wavy tops of the rectangle box FIG. 67A fits into the square boxes that are FIGS. 65B and 66B.

Figure 70B:
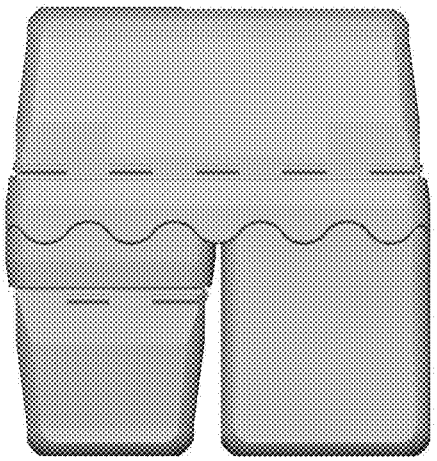

FIG. 70B is a profile view from the side of FIG. 70A.

Figure 71:
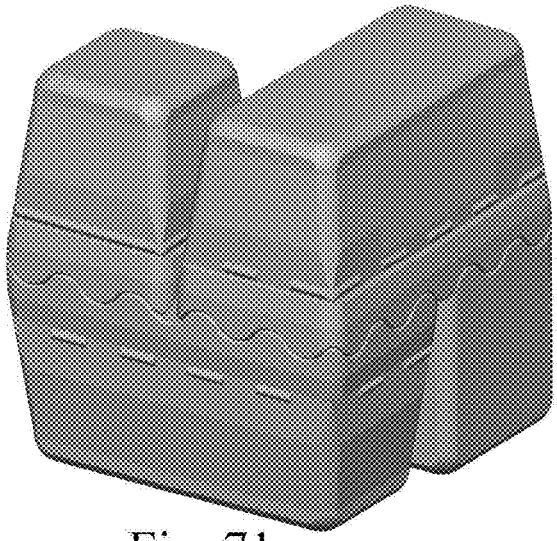

FIG. 71 shows how these boxes can be built out to be a construction that is as wide as it is deep and as it is tall, where all the boxes unite in the wavy middle.

Figure 72A:
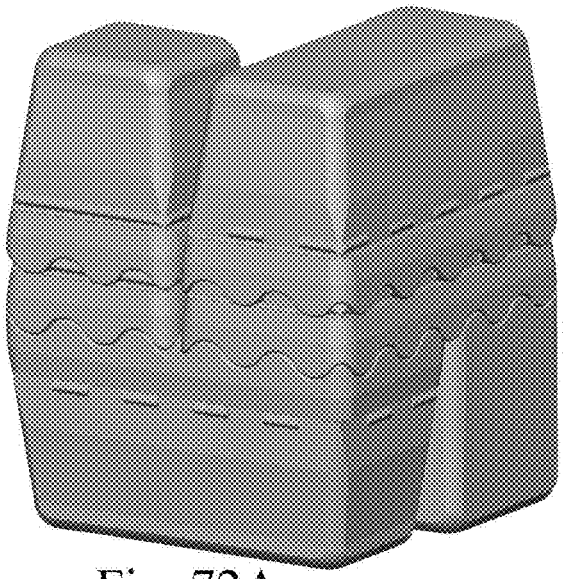

FIG. 72A shows how additional boxes can be stacked on top of the construction that is FIG. 71. FIGS. 72A, B and C are different views of the same construction.

Figure 72B:
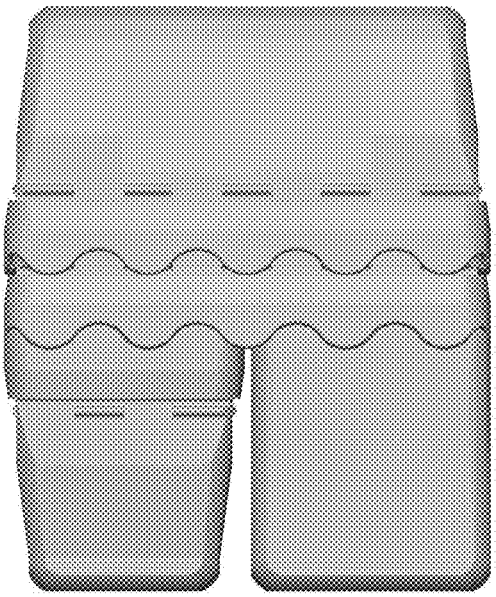

FIG. 72B is a profile view of a side of FIG. 72A.

Figure 72C:
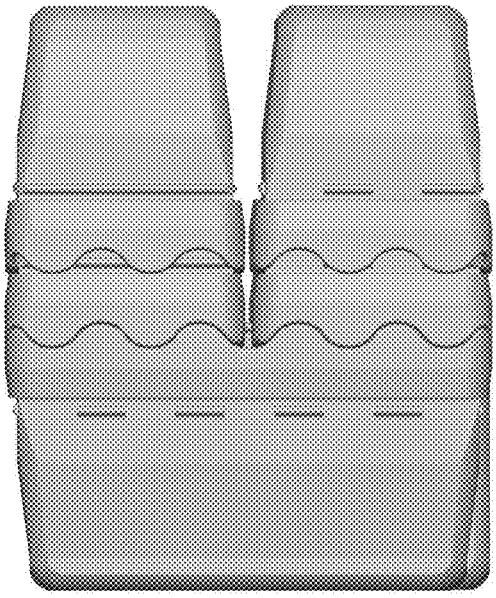

FIG. 72C is a profile view of another side of FIG. 72A.

Figure 73A:
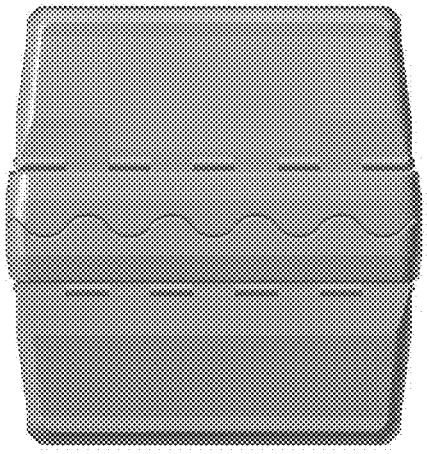
Figure 73B:
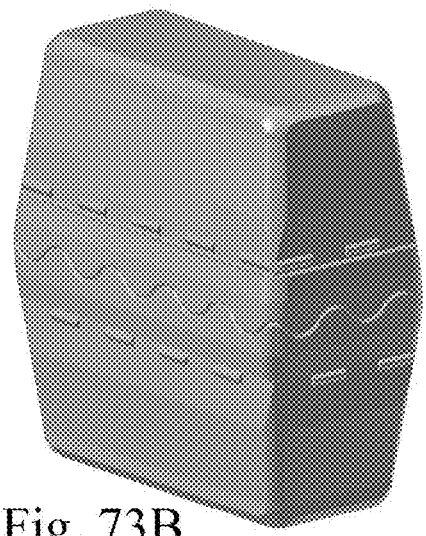

FIG. 73A is a profile view from a side of FIG. 73B.

FIG. 73B shows how two boxes that are the shape of FIG. 67A fits into themselves when the wavy top rests on itself.

Figure 74A:
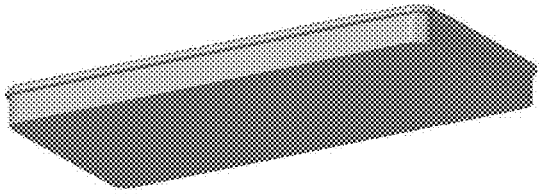

FIG. 74A is a top of the box that is FIG. 67A. It has a ridge at the top that operates as a male snap that fits into the boxes' female snaps to snap in place as a lid.

Figure 74B:
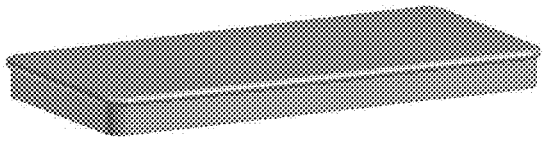

FIG. 74B is a view of the top of FIG. 74A.

Figure 75:
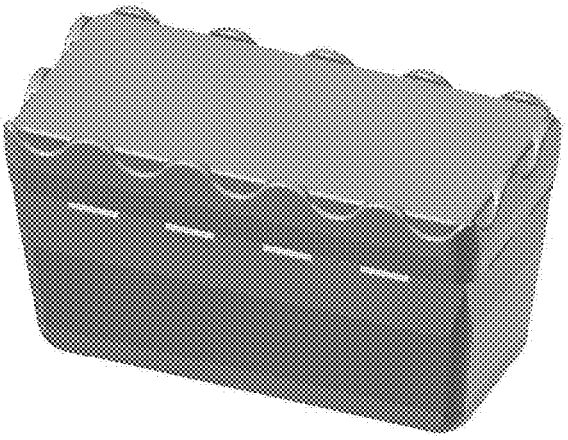

FIG. 75 is a demonstration of how FIG. 74A snaps into FIG. 67A to be a box with its lid on.

Figure 76:
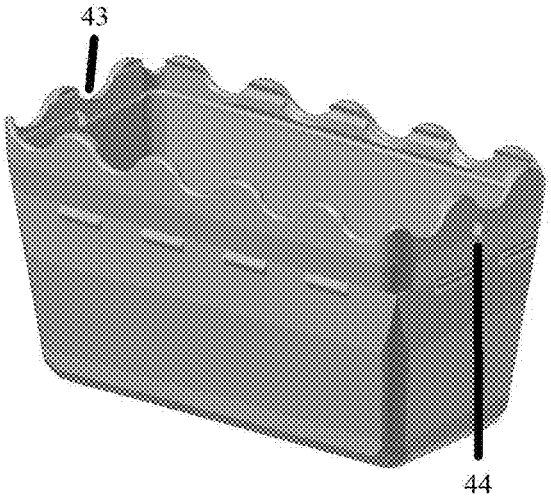

FIG. 76 is similar to FIG. 67A except it has holes into which a handle's ends can be placed. Those holes are labeled as elements 43 and 44.

Figure 77:
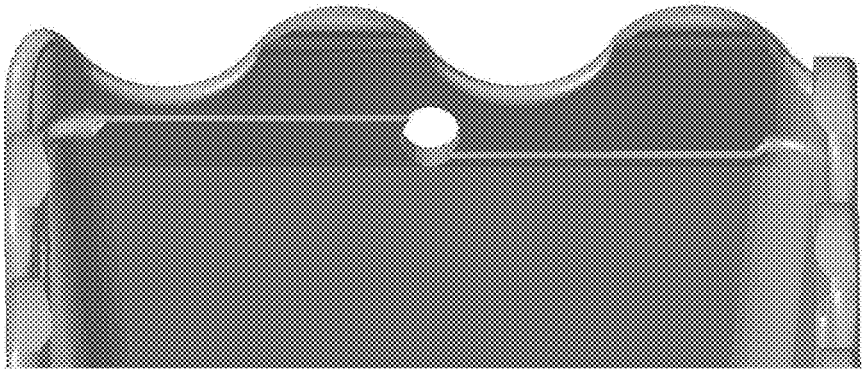

FIG. 77 is a closer view of the part of FIG. 76 with the hole and the resting place for the box handle.

Figure 78:
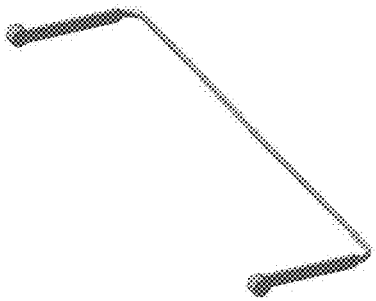

FIG. 78 is the box handle that can also be a lock in the manner described above.

Figure 79:
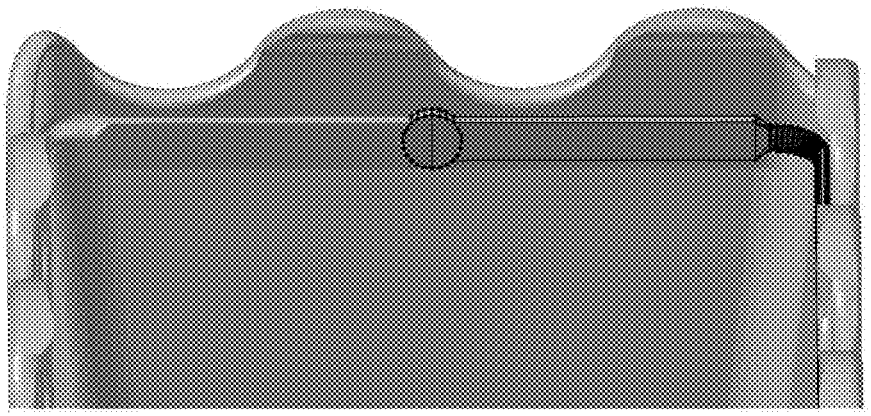

FIG. 79 shows the handle that is FIG. 78 inserted into the box.

Figure 80A:
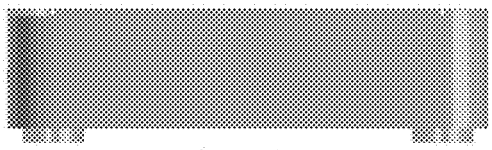
Figure 80B:
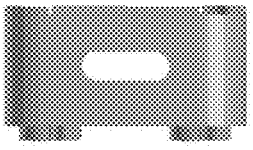
Figure 80C:
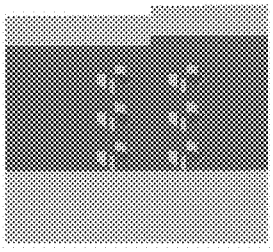
Figure 80D:
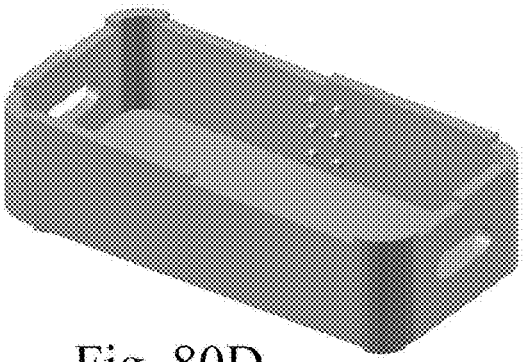

FIG. 80A is a profile view of the long side of FIG. 80D.

FIG. 80B is a profile view of the short side of FIG. 80D.

FIG. 80C is a close-up view of the knobs in the inside middle of FIG. 80D.

FIG. 80D is a rectangle box that is twice as long as it is wide.

Figure 80E:
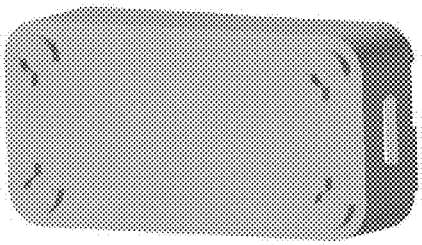
Figure 81A:
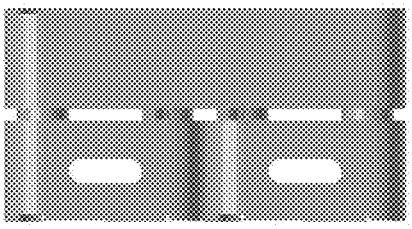
Figure 81B:
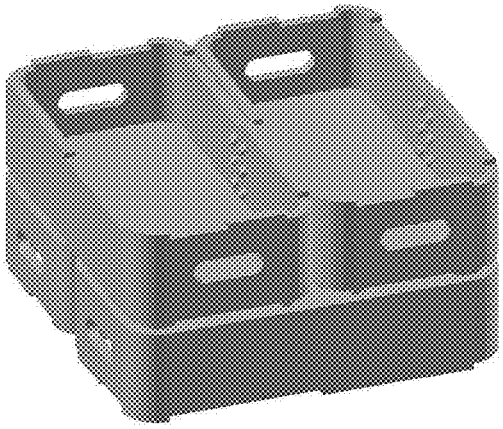

FIG. 80E shows the reversible feet of the box that allow the box to be assembled in the manner shown in FIG. 81B.

Figure 80F:
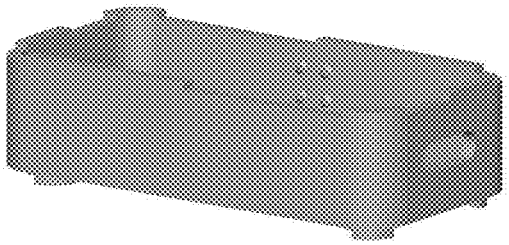

FIG. 80F is another view of FIG. 80D.

FIG. 81A is a profile view of how FIG. 80D stacks onto itself.

FIG. 81B is a demonstration of how FIG. 80D stacks onto itself.

Figure 82:
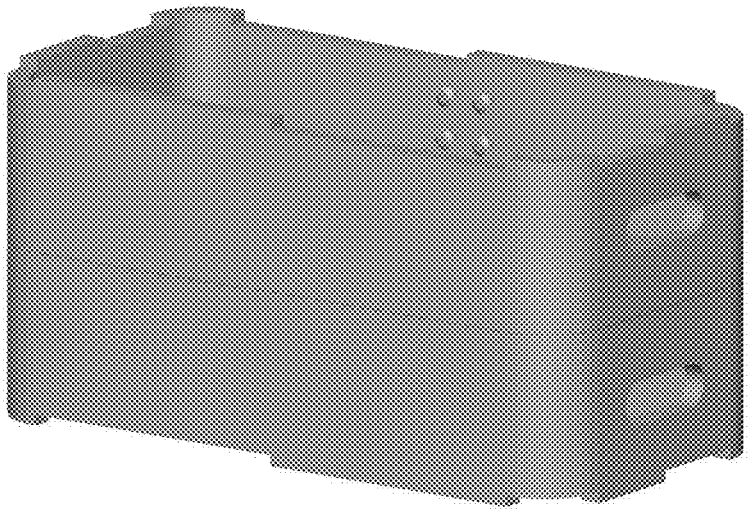
Figure 83:
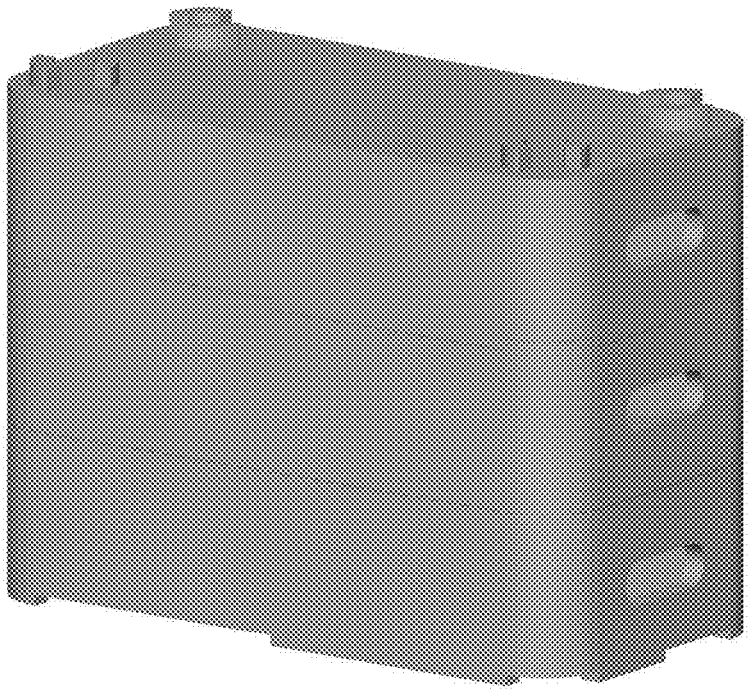
Figure 84:
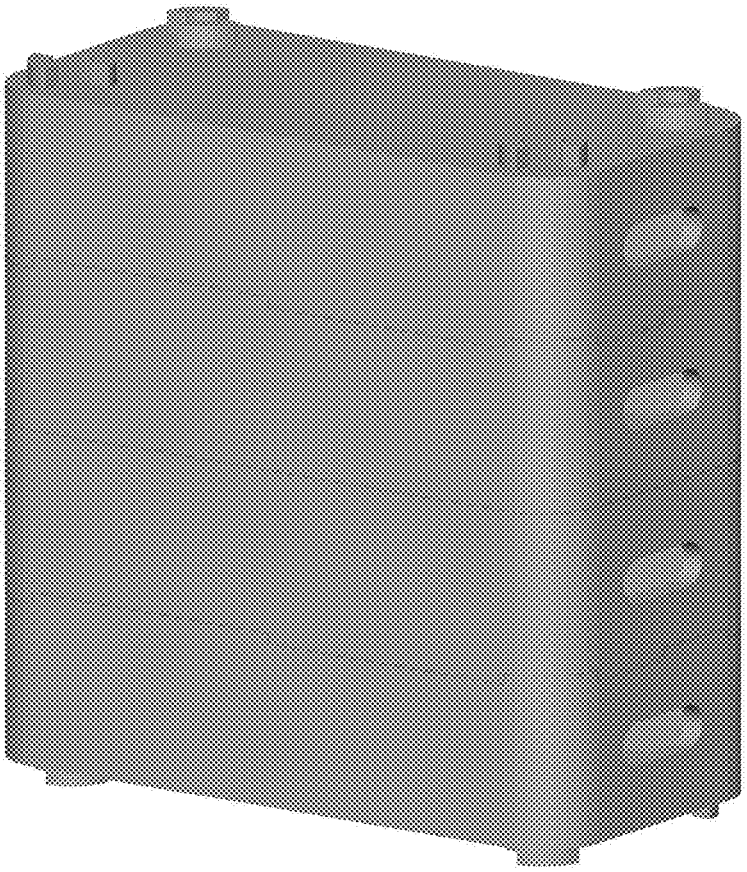

The indentations and protrusions on the top of the box allow it to be assembled m the manner shown in FIGS. 82, 83 and 84.

FIG. 82 is a demonstration of how FIG. 80D stacks onto itself.

FIG. 83 is another demonstration of how FIG. 80D stacks onto itself.

FIG. 84 is another demonstration of how FIG. 80D stacks onto itself.

All of the interfaces can be placed on the boxes of the invention to enable compact strong and versatile constructions, food storage, and a wide range of additional tasks.

DETAILED DESCRIPTION OF THE INVENTION

FIG. 1 is a flexible building block (built with flexible plastic or rubber and the like) that is as tall as it is wide as it is deep. It snaps together with itself (i.e., with other objects that are the same shape as itself) at the "s" snap locations identified by the element nos. 1 through 9. Element No. 5 is exactly half the size of the other "s" snaps (i.e., elements Nos. 1 through 4 and 6 through 9 because it snaps to a shape that is just like the shape in FIG. 1 except that it is half the size of the shape at FIG. 1A.

FIG. 1 can also be built with rigid materials (like ceramics, glass, cast iron, etc.) except that its "s" snaps cannot have protruding male bulges when interfacing with other FIG. 1 pieces that are made of rigid materials.

Figure 1A:
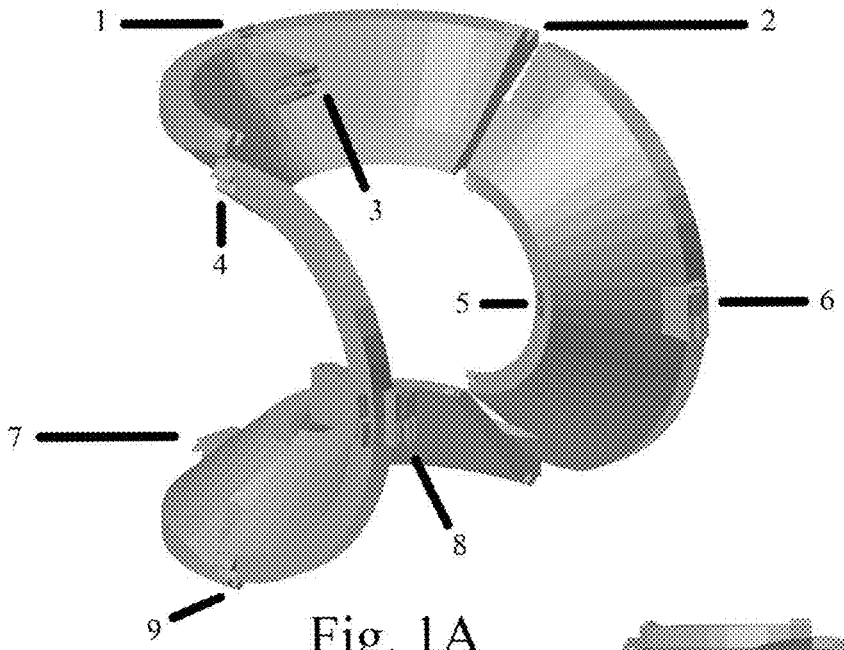
FIG. 1A is a flexible building block (built with flexible plastic or rubber and the like) that is as tall as it is wide as it is deep.
Figure 1B:
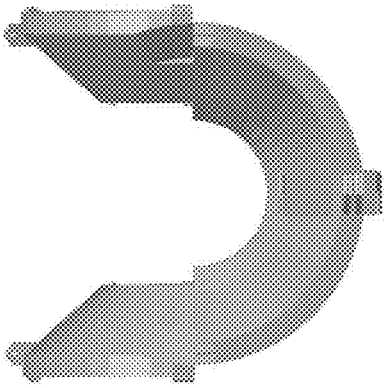
FIG. 1B is a different view of the same object that appears in FIG. 1A.
Figure 1C:
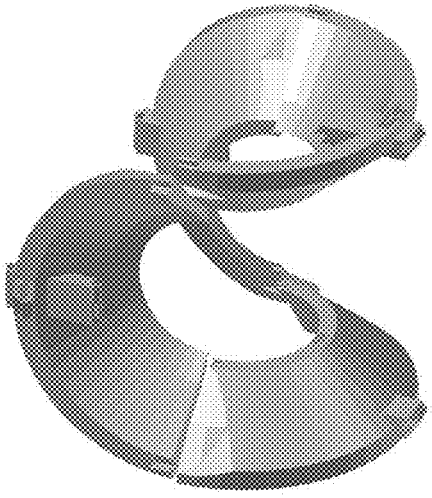
FIG. 1C is a different view of the same object that appears in FIG. 1A.
Figure 1D:
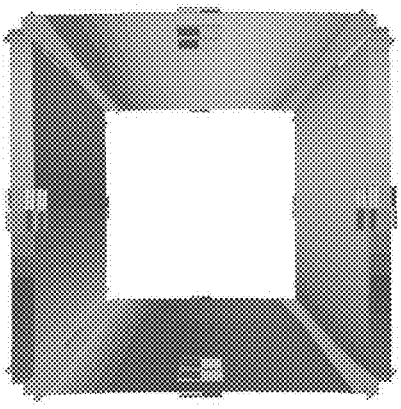
FIG. 1D is a different view of the same object that appears in FIG. 1A.

FIGS. 1B, 1C and ID are different views of the same object that appears in FIG. 1A.

Figure 2A:
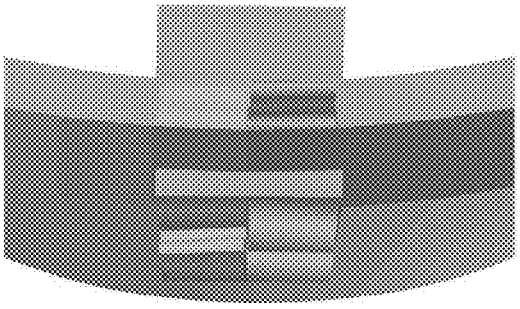
FIG. 2A is closeup view of the "s" snaps identified in the elements on FIG. 1A.
Figure 2B:
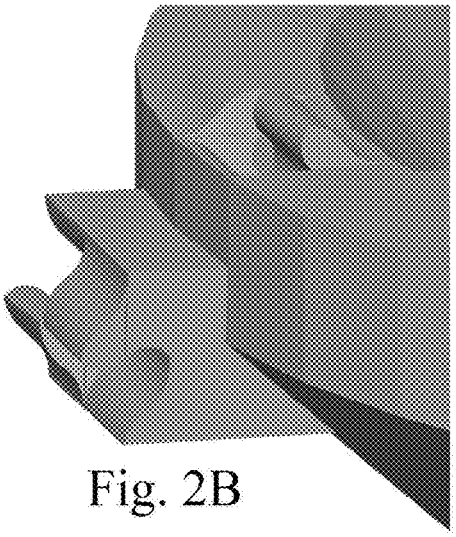
FIG. 2B is a side view of the "s" snaps in FIG. 2A.

FIG. 2 is closeup views of the "s" snaps identified in the elements on FIG. 1.

Figure 3:
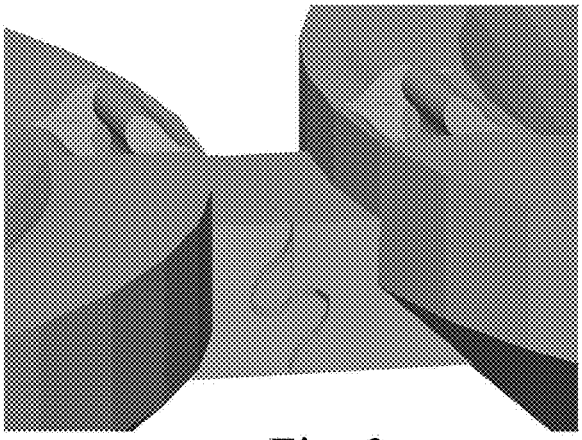
FIG. 3 is a closeup view of the "s" snaps of flexible materials when snapped together.

FIG. 3 is a closeup view of the "s" snaps of flexible materials when snapped together. Note that the edge of the "s" snaps that is closest to the viewer is not 100% snug because these snaps also snap into other snaps that are circular in nature.

Figure 4:
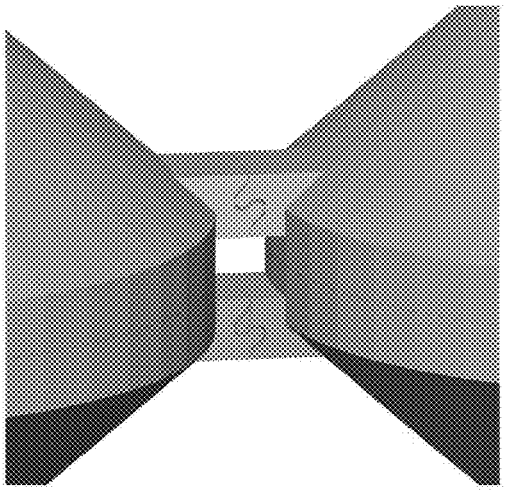
FIG. 4 is a closeup view of two FIG. 1A objects snapped together on the bottom, two FIG. 1A objects snapped together on the top, and those two sets of FIG. 1A objects snapped to each other vertically.

FIG. 4 is a closeup view of two FIG. 1 objects snapped together on the bottom, two FIG. 1 objects snapped together on the top, and those two sets of FIG. 1 objects snapped to each other vertically.

Figure 5:
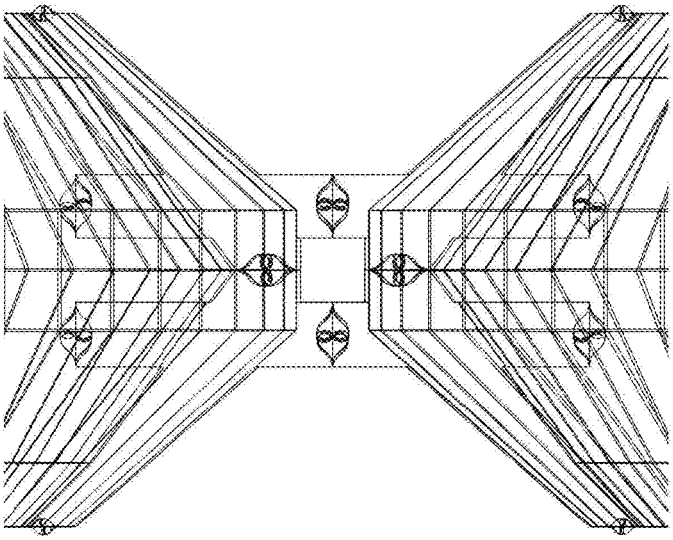
FIG. 5 is a view of the same set of objects snapped together as shown in FIG. 4 except the wireframe view shows each of the four "s" snap connections at the center of FIG. 5.

FIG. 5 is a view of the same set of objects snapped together as shown in FIG. 4 except the wireframe view shows each of the four "s" snap connections at the center of FIG. 5.

Figure 6:
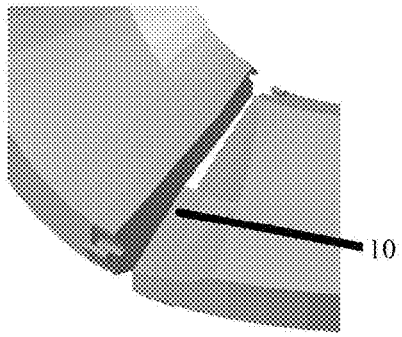
FIG. 6 is a closeup view of the part of the object at FIG. 1 in the location where it can open up when built with flexible materials.
Figure 7A:
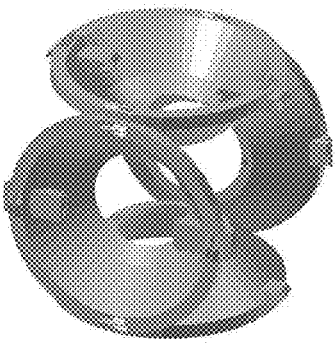
FIG. 7A is a view of two FIG. 1A objects slid together to form a more sturdy equilateral object that has the same height, length and depth.
Figure 7B:
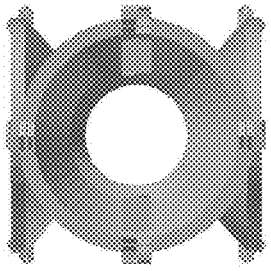
FIG. 7B is a profile view from the top of FIG. 7A.
Figure 7C:
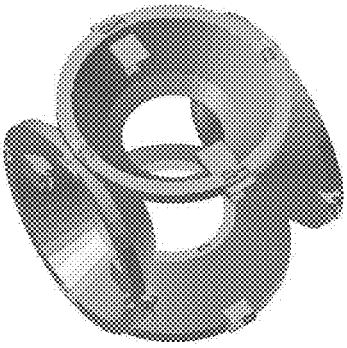
FIG. 7C is a view from the top of FIG. 7A.
Figure 7D:
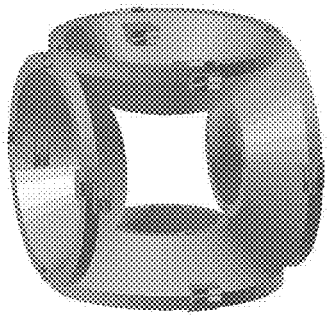
FIG. 7D is a view from the front of FIG. 7D.
Figure 8A:
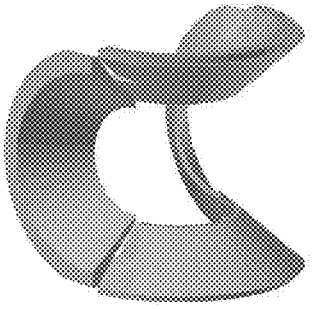
FIG. 8A is the same as FIG. 1A except it does not have "s" snaps.
Figure 8B:
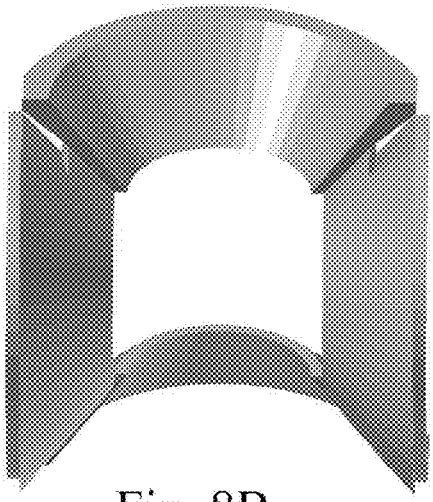
FIG. 8B is a different view of FIG. 8A.
Figure 8C:
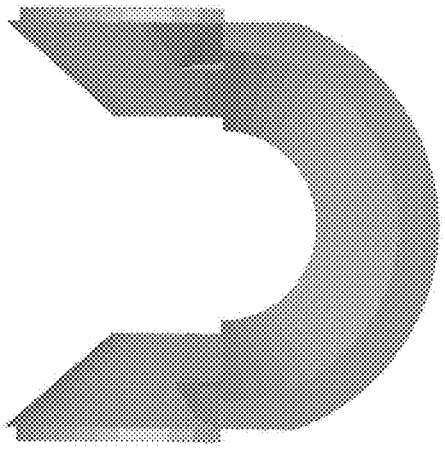
FIG. 8C is a top profile view of FIG. 8A.

FIG. 6 is a closeup view of the part of the object at FIG. 1 in the location where it can open up when built with flexible materials. The part identified as element No. 10 is where the piece bends out to allow one FIG. 1 piece to slide together with another FIG. 1 piece to form the construction shown in FIG. 7.

FIG. 7 is a view of two FIG. 1 objects slid together to form a sturdier equilateral object that has the same height, length and depth. This construction is possible when at least one of the pieces is made with flexible materials, or when both of the pieces are made with flexible materials.

Figure 9A:
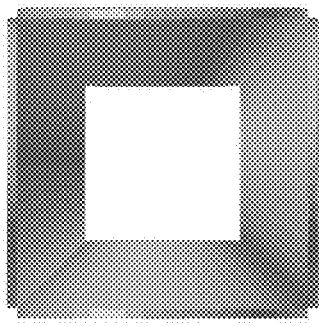
FIG. 9A is a profile view from the front of FIG. 9B.
Figure 9B:
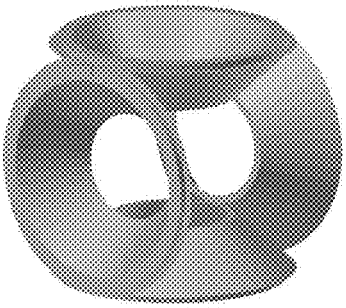
FIG. 9B is a view of two objects affixed together like FIG. 7A except it does not have the "s" snaps. Instead of "s" snaps (or in addition to "s" snaps) these objects can be held together magnetically, with poles or beams running through the circular center, or the pieces can be screwed together, nailed together or affixed or locked together in a wide range of ways.
Figure 9C:
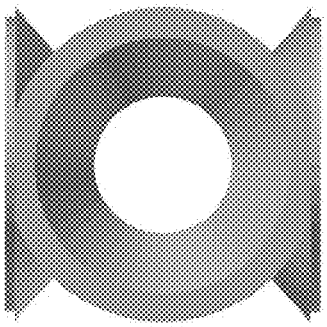
FIG. 9C is a profile view from the top of FIG. 9B.
Figure 1D:
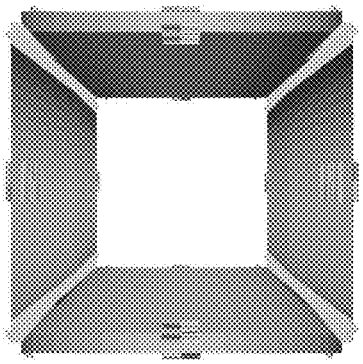

FIG. 9 is a view of two objects affixed together like FIG. 7 except it does not have the "s" snaps. Instead of "s" snaps (or in addition to "s" snaps) these objects can be held together magnetically, with poles or beams running through the circular center, or the pieces can be screwed together, nailed together or affixed or locked together in a wide range of ways.

Figure 10A:
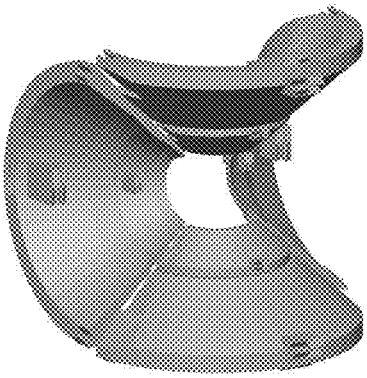
FIG. 10A is a demonstration of how FIG. 1A can be reinforced with another object just like it that is exactly half its size.
Figure 10B:
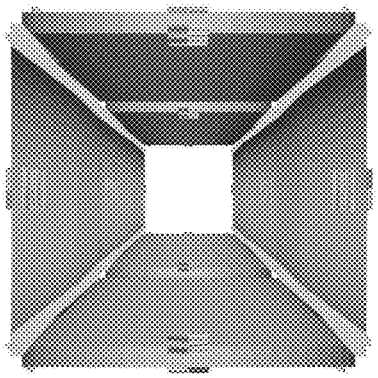
FIG. 10B is a profile view from the front of FIG. 10A.

FIG. 10 is a demonstration of how FIG. 1 can be reinforced with another object just like it that is exactly half its size. FIG. 1D appears next to FIG. 10A as a reference to remind the viewer exactly what FIG. 1 looks like.

Figure 11A:
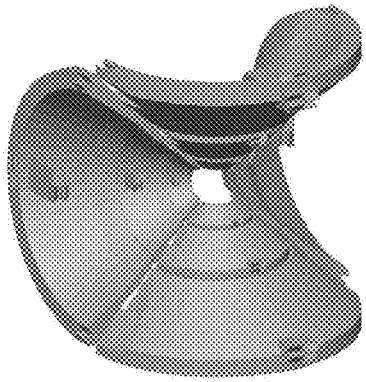
FIG. 11A is a view of how FIG. 10A can in turn be reinforced with another FIG. 1A shape that is half the size of the shape it fits into in the middle of the construction.
Figure 11B:
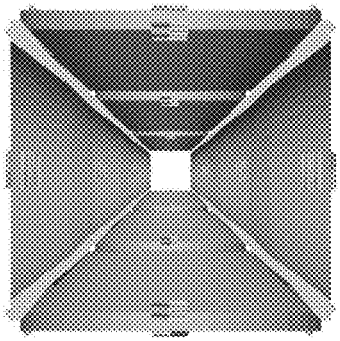
FIG. 11B is a profile view from the front of FIG. 11A.
Figure 11C:
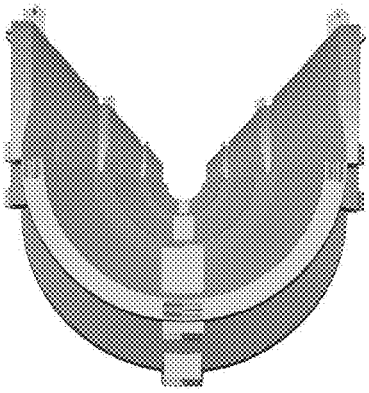
FIG. 11C is a profile view from the top of FIG. 11A.
Figure 12A:
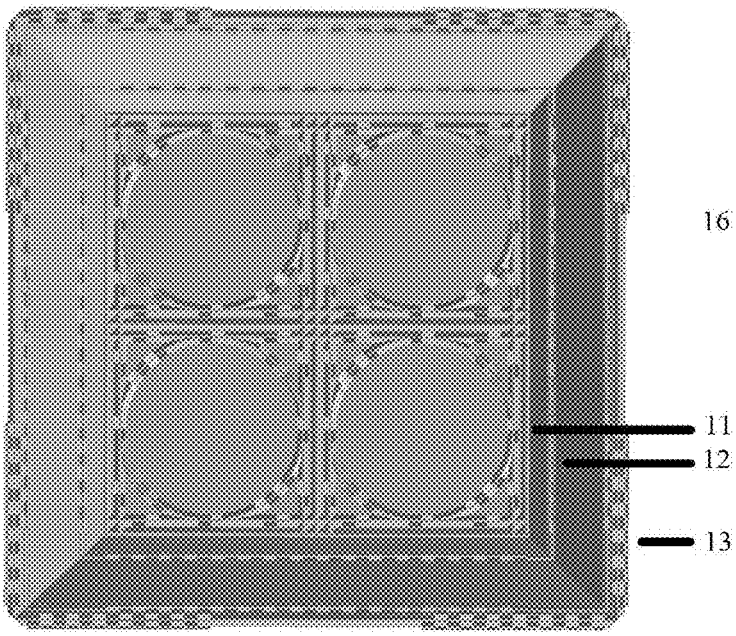
FIG. 12A is a square box that fits into itself like a burger box fits into itself.
Figure 12D:
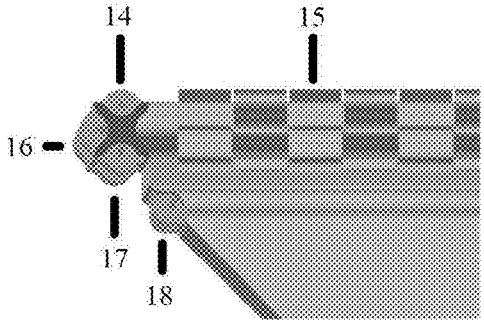
FIG. 12D is a near-profile side view of an edge of FIG. 12A.
Figure 12E:
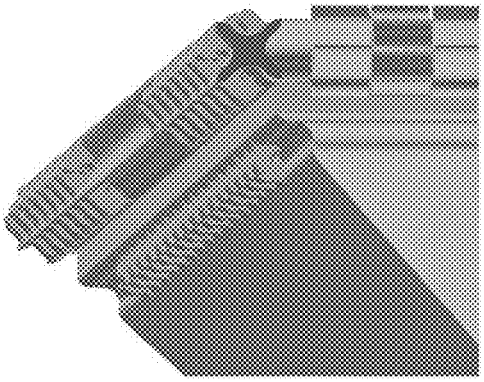
FIG. 12E is a side view close-up of FIG. 12A.
Figure 12B:
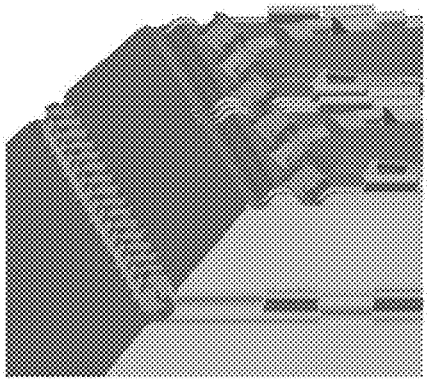
FIG. 12B is a close-up view of an edge of FIG. 12A.
Figure 12C:
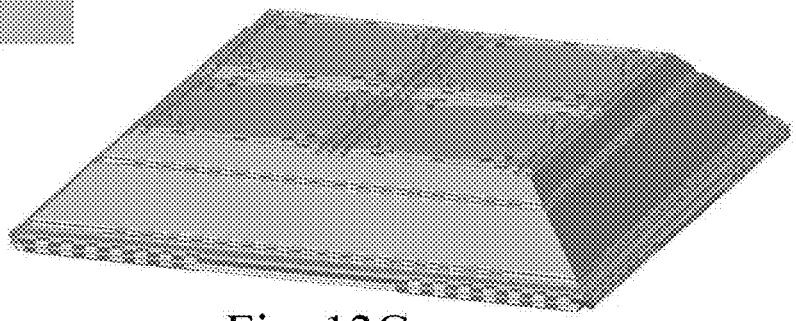
FIG. 12C is a top corner view of FIG. 12A.
Figure 13A:
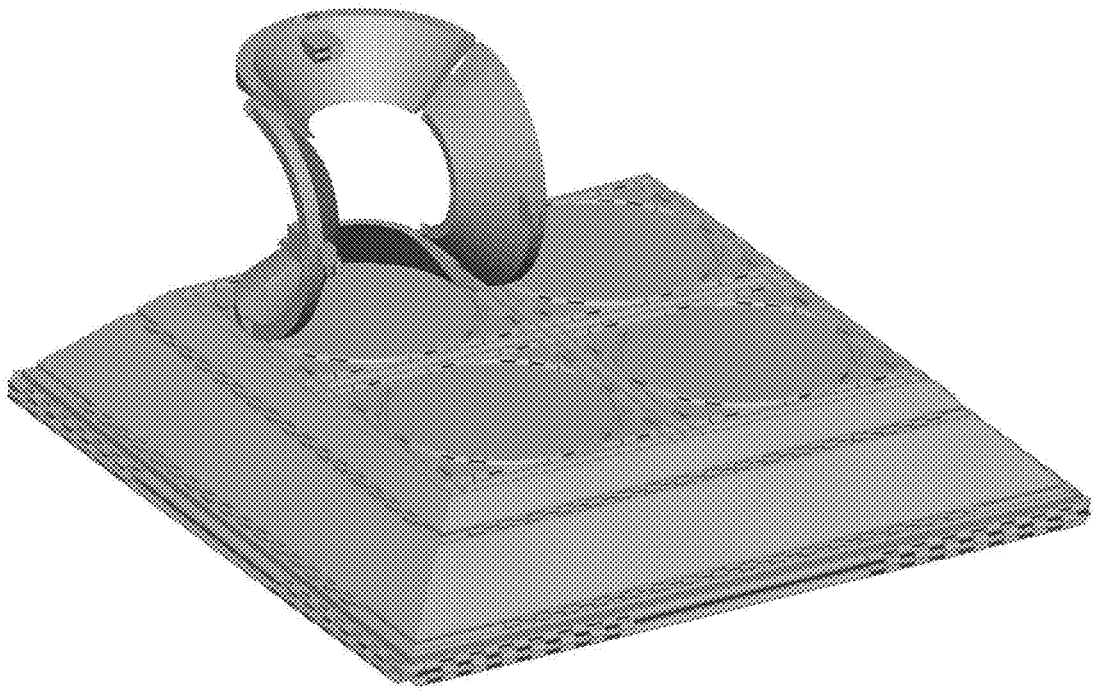
FIG. 13A is a demonstration of how the "s" snaps of FIG. 1A fit into the box that is FIG. 12A.
Figure 13B:
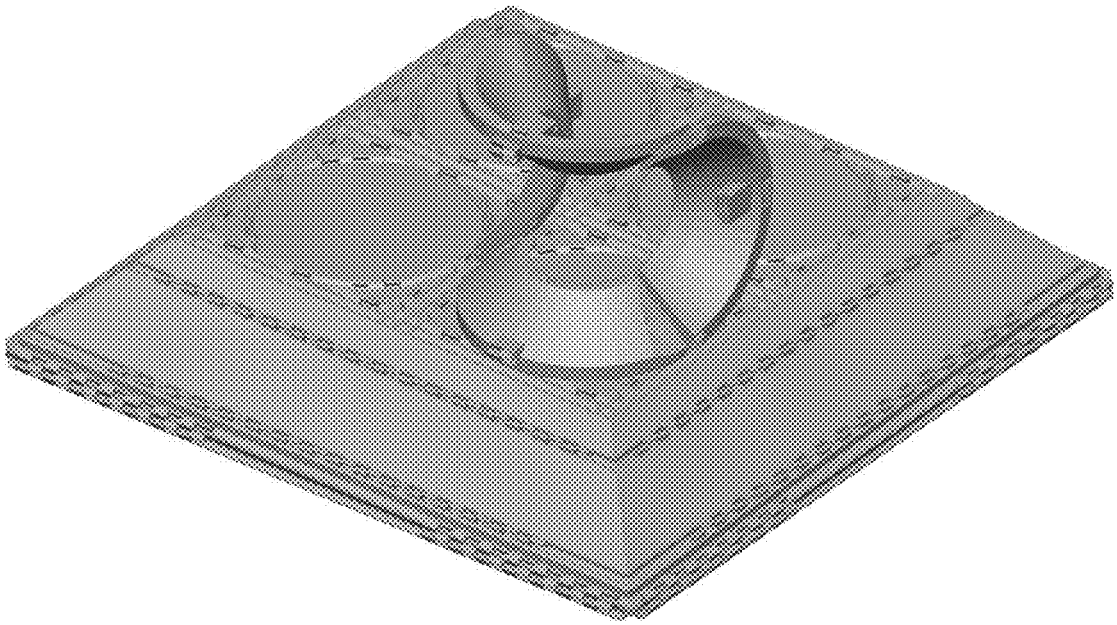
FIG. 13B is another view of FIG. 13A.
Figure 13C:
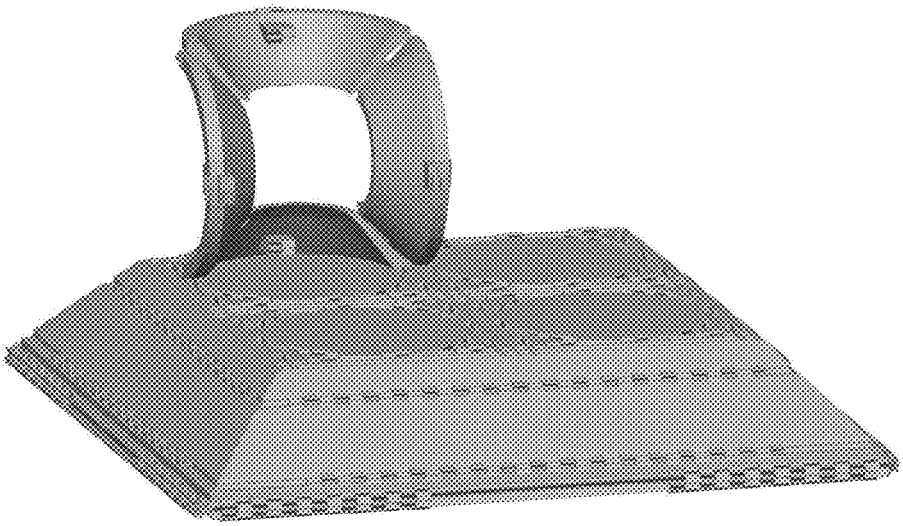
FIG. 13C is another view of FIG. 13A.
Figure 13D:
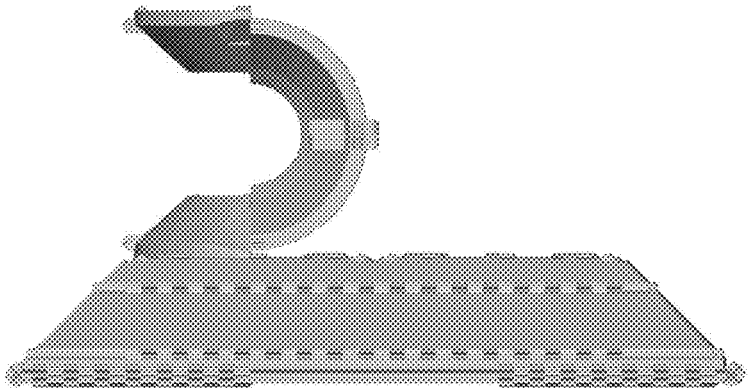
FIG. 13D is a profile view from the side of FIG. 13A.
Figure 13E:
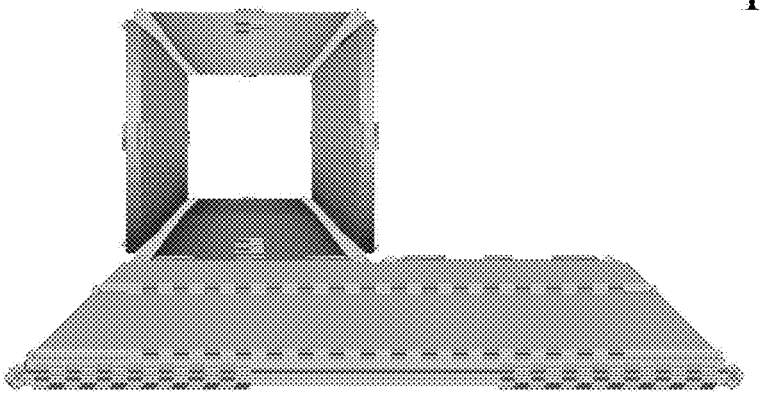
FIG. 13E is another profile view from another side of FIG. 13A.

FIG. 11 is a view of ho FIG. 10 can in turn be reinforced with another FIG. 1 shape that is half the size of the shape it fits into in the middle of the construction.

FIG. 12 is a square box that fits into itself like a burger box fits into itself. FIG. 12 also snaps into itself with "s" snaps just like those found on FIG. 1. The "s" snaps are found at the location of each of the elements at Nos. 11 through 18.

FIG. 13 is a demonstration (from differing views) of how the "s" snaps of FIG. 1 fit into the box that is FIG. 12.

Figure 14A:
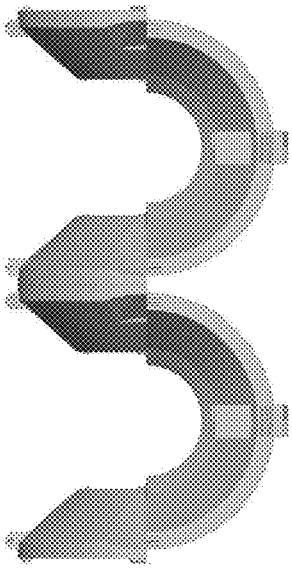
FIG. 14A is a profile view from the side of FIG. 14B.
Figure 14B:
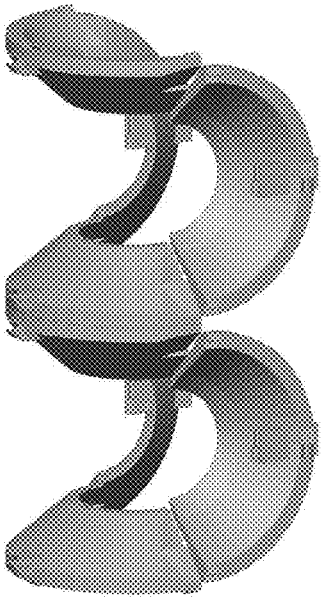
FIG. 14B is a demonstration of how FIG. 1A can be stacked vertically and snapped together.

FIG. 14 is a demonstration of how FIG. 1 can be stacked vertically and snapped together.

Figure 15:
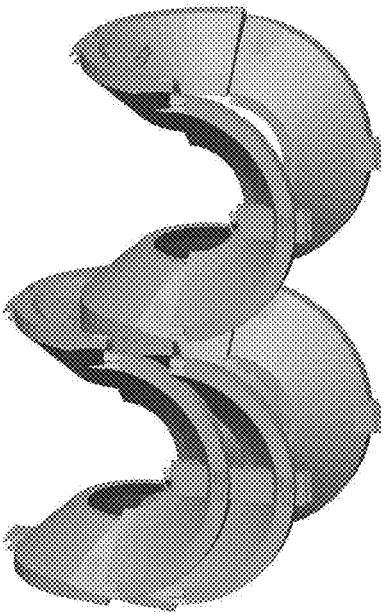
FIG. 15 is a demonstration of how FIG. 1A can be stacked vertically and how it can be stacked horizontally in a reinforced position or in a position that saves space relative to how the pieces can be assembled when snapped together in a mirror image of each other.

FIG. 15 is a demonstration of how FIG. 1 can be stacked vertically and how it can be stacked horizontally in a reinforced position or in a position that saves space relative to how the pieces can be assembled when snapped together in a mirror image of each other.

Figure 16:
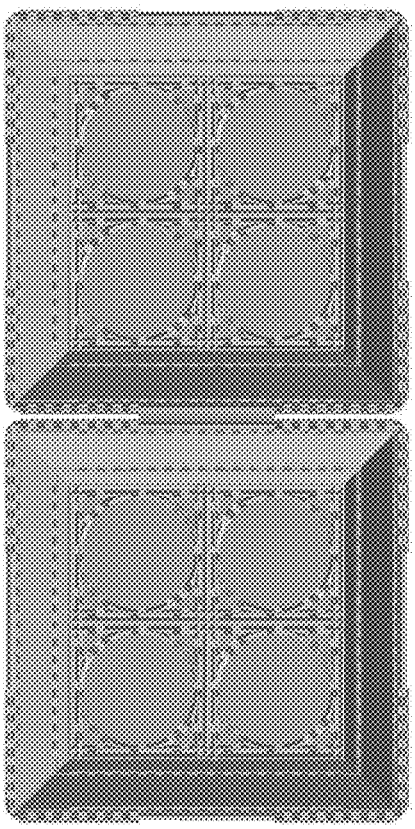
FIG. 16 is a demonstration of how FIG. 12A appears when it is a full burger box that can fold to close, but that also can be stacked into itself and snapped at the same time to form a secure stacking structure.

FIG. 16 is a demonstration of how FIG. 12 appears when it is a full burger box that can fold to close, but that also can be stacked into itself and snapped at the same time to form a secure stacking structure.

Figure 17:
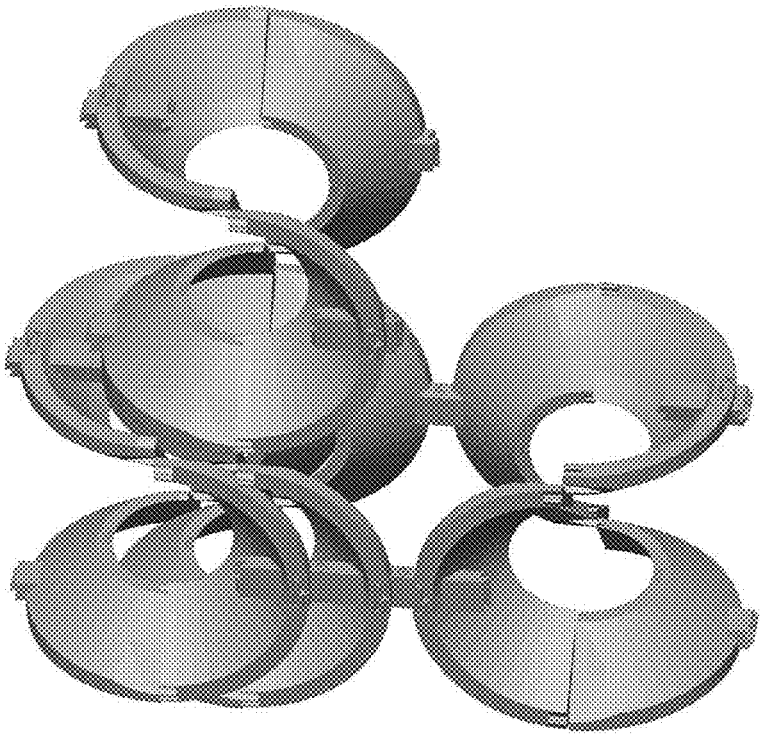
FIG. 17 is a demonstration of how FIG. 1A can be stacked vertically and horizontally in an efficient way (in the manner shown to the left of the FIG.) and less efficiently to occupy more space (as is shown toward the bottom right of FIG. 17).

FIG. 17 is a demonstration of how FIG. 1 can be stacked vertically and horizontally in an efficient way (in the manner shown to the left of the FIG.) and less efficiently to occupy more space (as is shown toward the bottom right of FIG. 17).

Figure 18:
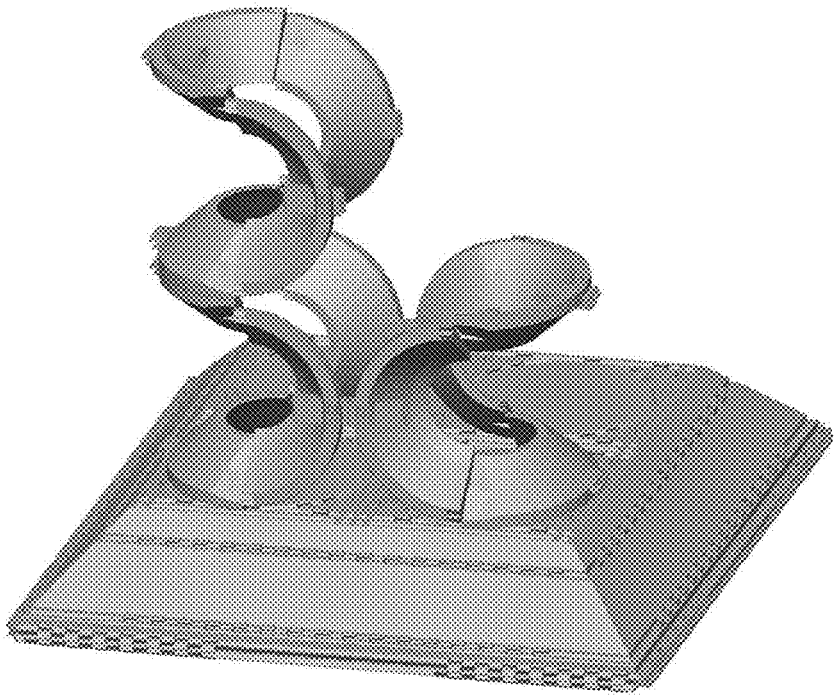
FIG. 18 is a demonstration of how multiple FIG. 1A pieces can be snapped together and snapped onto FIG. 12A.

FIG. 18 is a demonstration of how multiple FIG. 1 pieces can be snapped together and snapped onto FIG. 12.

Figure 19:
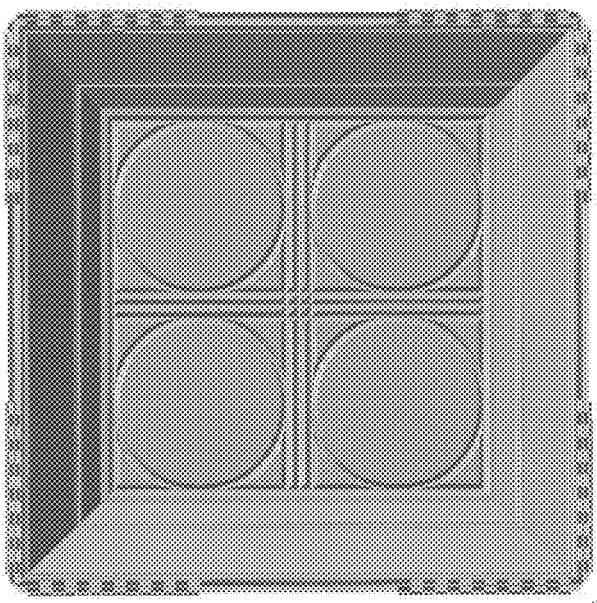
FIG. 19 is a view of the inside of the box that is FIG. 12A.

FIG. 19 is a view of the inside of the box that is FIG. 12. Indentations exist where the "s" snaps go so as to allow for food to be placed in the box without being caught in the "s" snaps. However, "s" snaps can be placed in the location of the inner circles and horizontal lines if the box will not be used in a re-usable manner for food and instead will serve as a building block that benefits from the greater strength afforded by the "s" snap connections.

Figure 20:
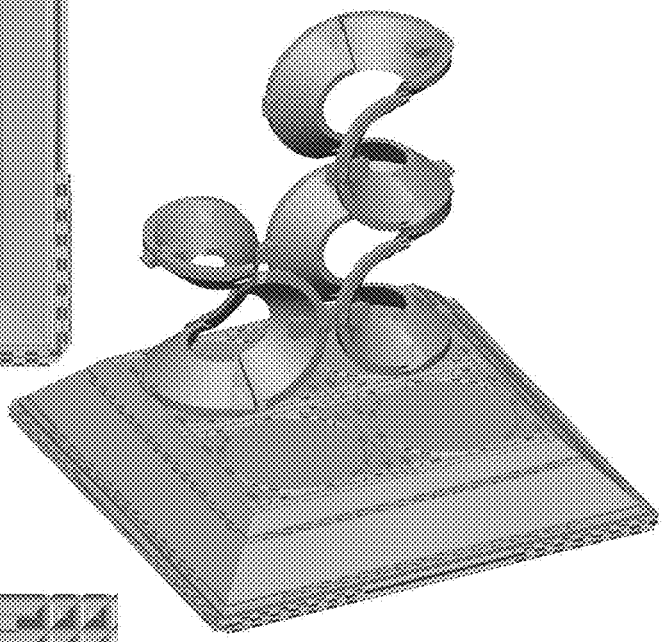
FIG. 20 is a different view of the construction at FIG. 18.

FIG. 20 is a different view of the construction at FIG. 18.

Figure 21:
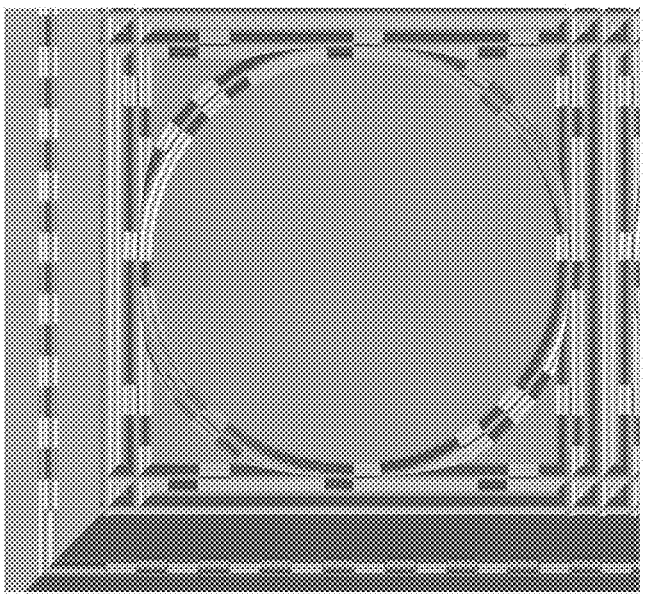
FIG. 21 is a closeup view of the circles and squares on the box that is FIG. 12A and the "s" snaps that form patterns on that box.

FIG. 21 is a closeup view of the circles and squares on the box that is FIG. 12 and the "s" snaps that form patterns on that box.

Figure 22A:
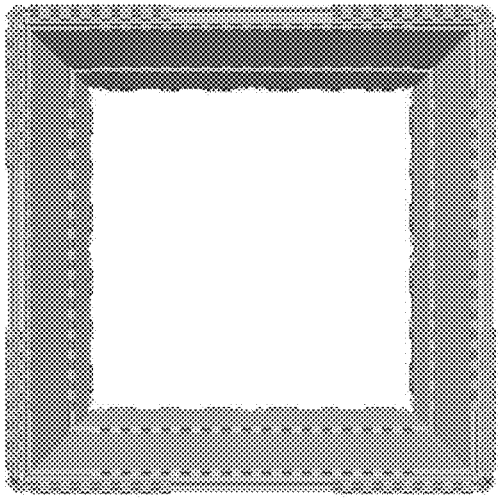
FIG. 22A is a profile view from an open side of FIG. 22B.
Figure 22B:
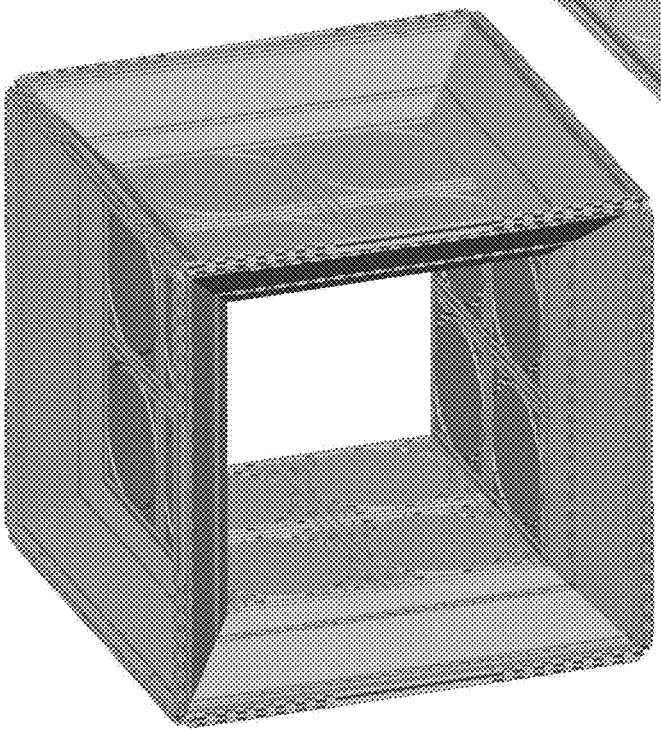
FIG. 22B is a demonstration of how the boxes that are FIG. 12A can be snapped together to form a larger construction.

FIG. 22 is a demonstration of how the boxes that are FIG. 12 can be snapped together to form a larger construction. That larger construction can in turn fit into itself to form even larger constructions, like a wall.

Figure 23:
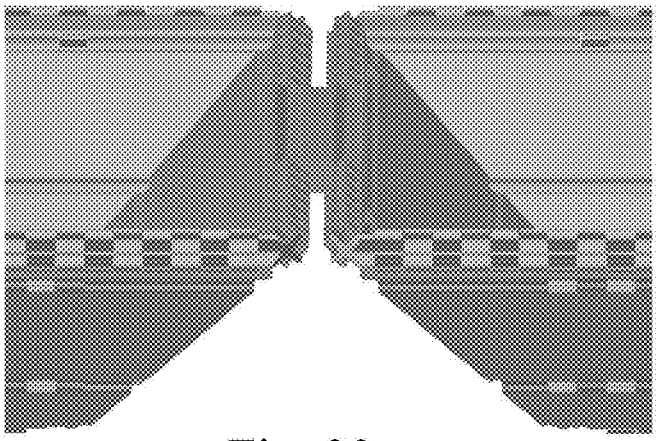
FIG. 23 is a close-up view of FIG. 24.
Figure 24:
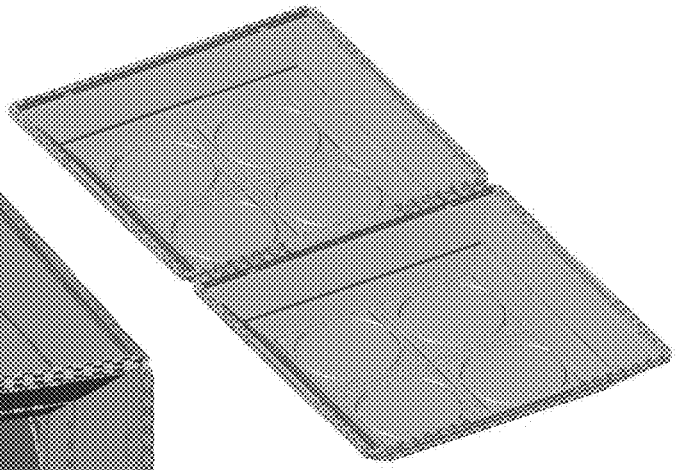
FIG. 24 is a demonstration of how to boxes that are FIG. 12A can be joined together like a burger box.

FIG. 23 is a demonstration of how to boxes that are FIG. 12 can be joined together like a burger box. The joined boxes can be bent so that one side of the box is the lid for the other side. They can also be bent the other direction to form the construction that is FIG. 22.

Figure 25A:
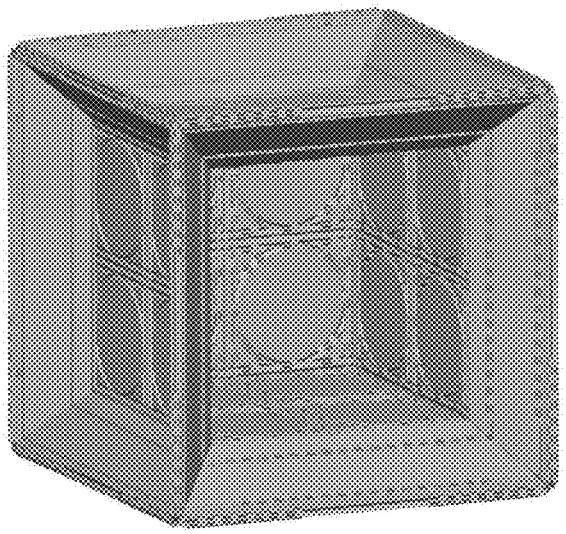
FIG. 25A is a view of how FIG. 12A can be snapped together to form a larger box.
Figure 25B:
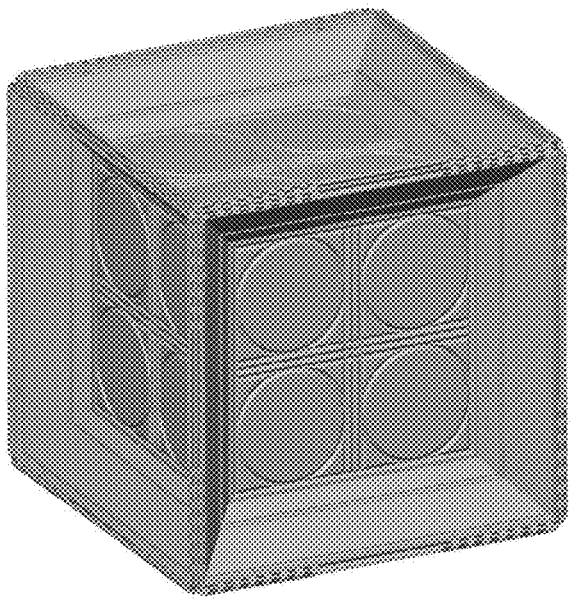
FIG. 25B is a view of the bottom of FIG. 25A.

FIG. 25 is a view of how FIG. 12 can be snapped together to form a larger box. FIG. 25A is a view inside the box and FIG. 25B is a view of the bottom of that same box.

Figure 26:
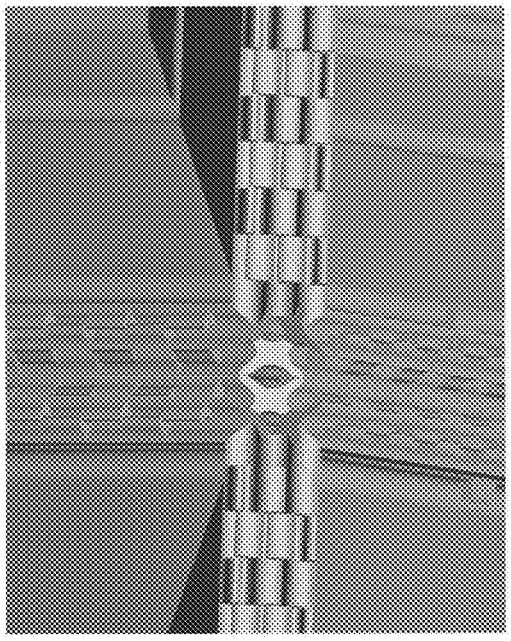
FIG. 26 is an up-close view of how the "s" snaps on the FIG. 12A boxes fit together at the corners of the construction at FIG. 25A.

FIG. 26 is an up-close view of how the "s" snaps on the FIG. 12 boxes fit together at the corners of the construction at FIG. 25.

Figure 27:
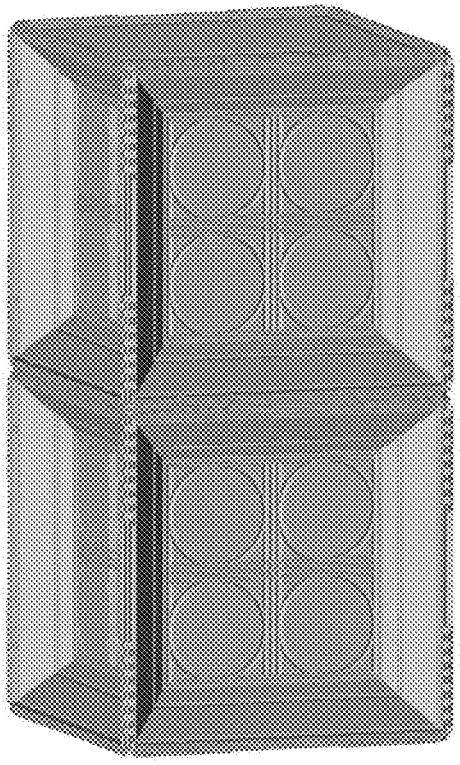
FIG. 27 is a demonstration of how the boxes at FIG. 25A can be assembled together to form larger constructions.

FIG. 27 is a demonstration of how the boxes at FIG. 25 can be assembled together to form larger constructions.

FIG. 28 is the other side of the boxes that are assembled in FIG. 27. These boxes form shelves when snapped together in this manner.

FIG. 29 is a demonstration of how FIG. 1, when snapped to itself two times in the manner shown, can go inside the construction at FIG. 28 to reinforce it in the manner shown in FIG. 29.

FIG. 30 is a different view of the construction at FIG. 29.

Figure 31:
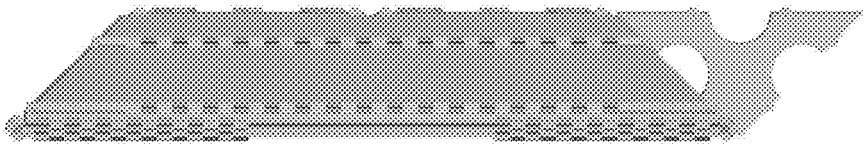
FIG. 31 is a profile-view of a demonstration of how the box that is FIG. 12A can be reinforced along a side with a triangular stick that snaps on to the side of FIG. 12A with "s" snaps.

FIG. 31 is a profile-view of a demonstration of how the box that is FIG. 12 can be reinforced along a side with a triangular stick that snaps on to the side of FIG. 12 with "s" snaps.

Figure 32:
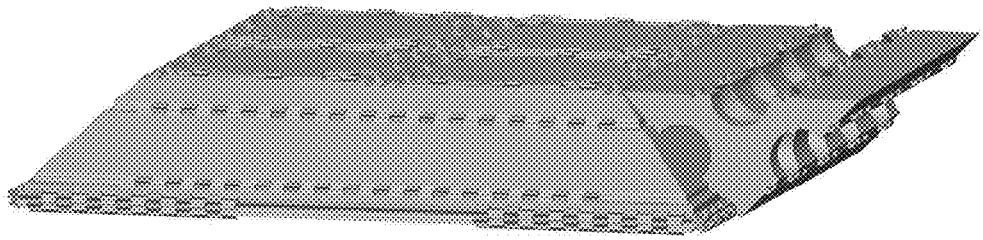
FIG. 32 is a different view of FIG. 31.

FIG. 32 is a different view of FIG. 31.

Figure 33:
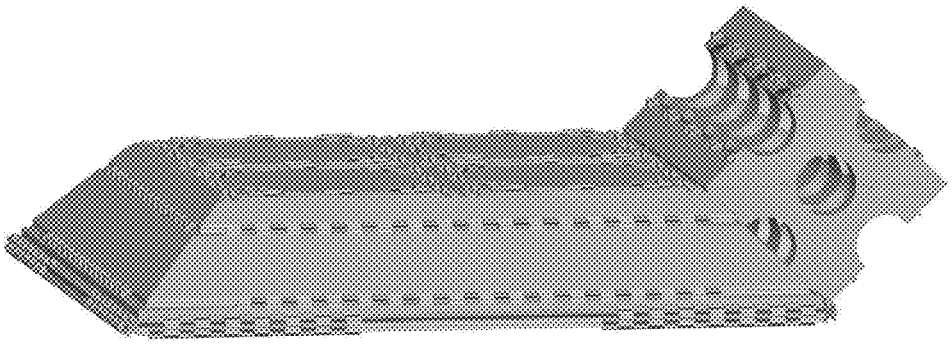
FIG. 33 is the same construction found in FIG. 32 except that the triangular reinforcing shape has an additional identical triangular shape fit into itself with "s" snaps.

FIG. 33 is the same construction found in FIG. 32 except that the triangular reinforcing shape has an additional identical triangular shape fit into itself with "s" snaps.

Figure 34:
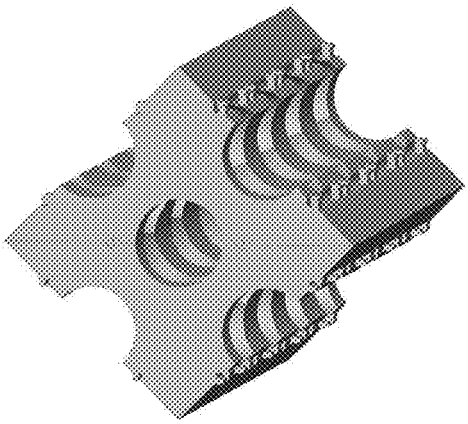
FIG. 34 is a view of only the triangular shapes snapped together to form a square beam.

FIG. 34 is a view of only the triangular shapes snapped together to form a square beam.

Figure 35:
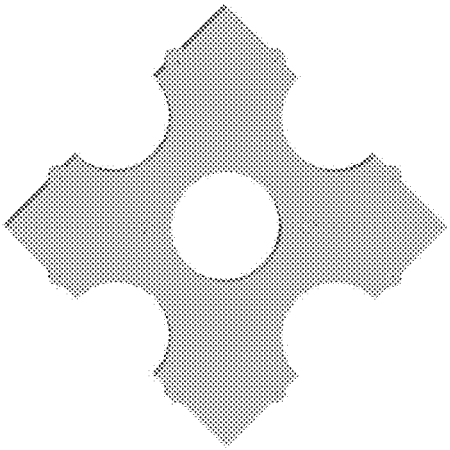
FIG. 35 is a profile view of the construction at FIG. 34.

FIG. 35 is a profile view of the construction at FIG. 34.

Figure 36:
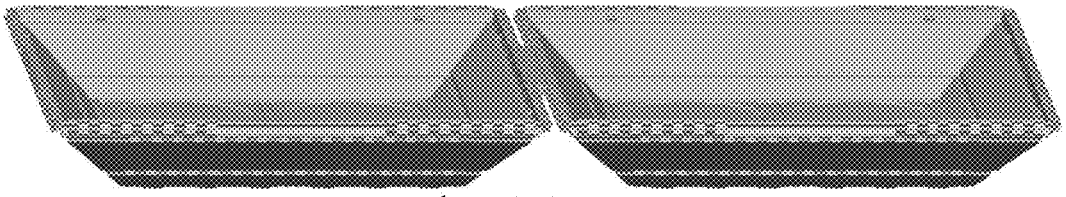
FIG. 36 is a view of the FIG. 12A box joined together with another FIG. 12A box to form a burger box.

FIG. 36 is a view of the FIG. 12 box joined together with another FIG. 12 box to form a burger box.

Figure 37:
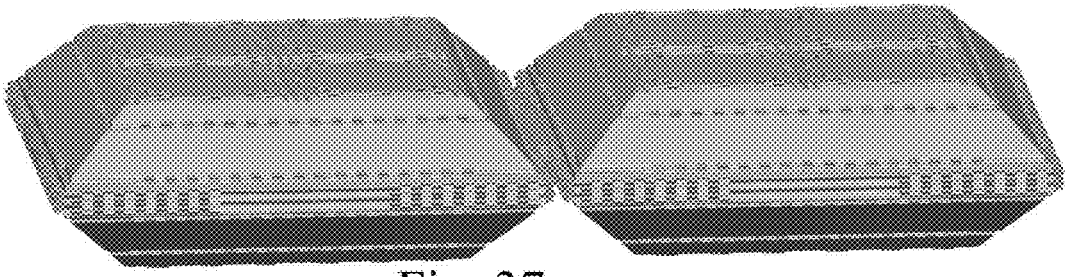
FIG. 37 shows how to FIG. 25 shapes can snap together to form two enclosed boxes that can hold objects inside, or that can be used as building blocks.

FIG. 37 shows how to FIG. 25 shapes can snap together to form two enclosed boxes that can hold objects inside, or that can be used as building blocks.

Figure 38:
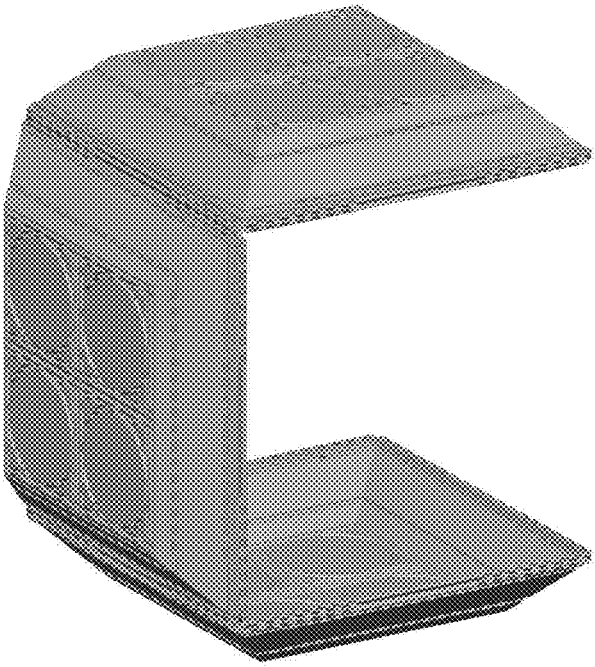
FIG. 38 is a demonstration of how FIG. 36 can be joined up with a FIG. 12A box.

FIG. 38 is a demonstration of how FIG. 36 can be joined up with a FIG. 12 box.

Figure 39:
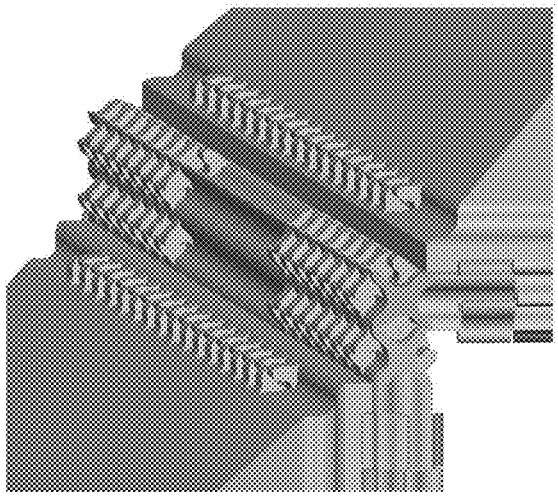
FIG. 39 is a closeup view of how the "s" snaps of FIG. 38 look when the boxes are together.
Figure 40A:
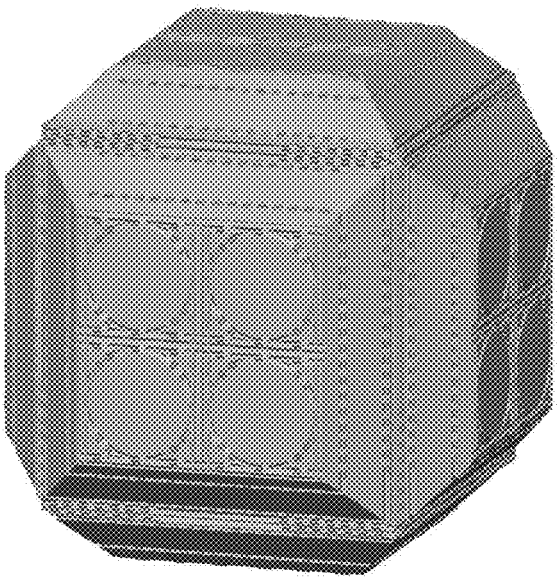
FIG. 40A is different views of the box that results when two FIG. 38 shapes fit into themselves to form a box.
Figure 40B:
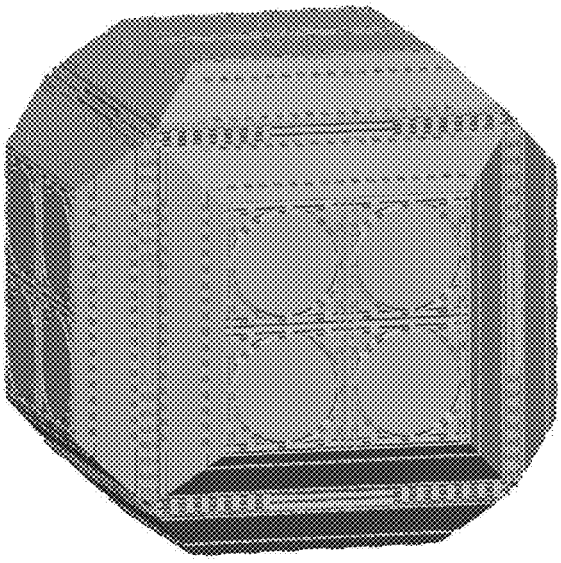
FIG. 40B is a different view of FIG. 40A.
Figure 40C:
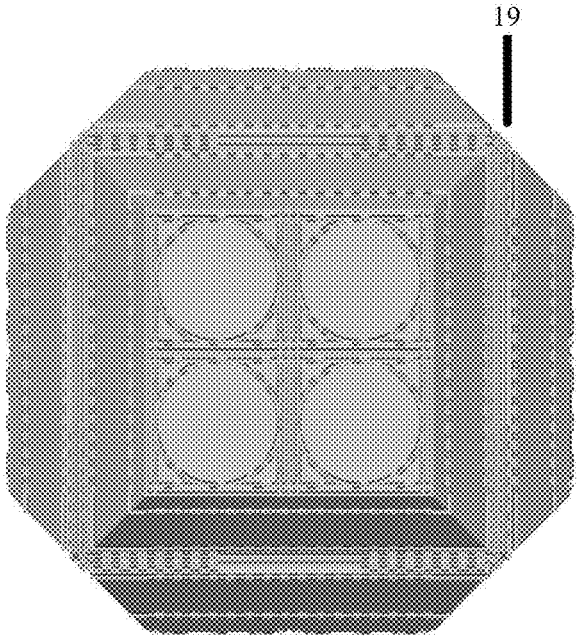
FIG. 40C is a profile view from a side of FIG. 40A.
Figure 40D:
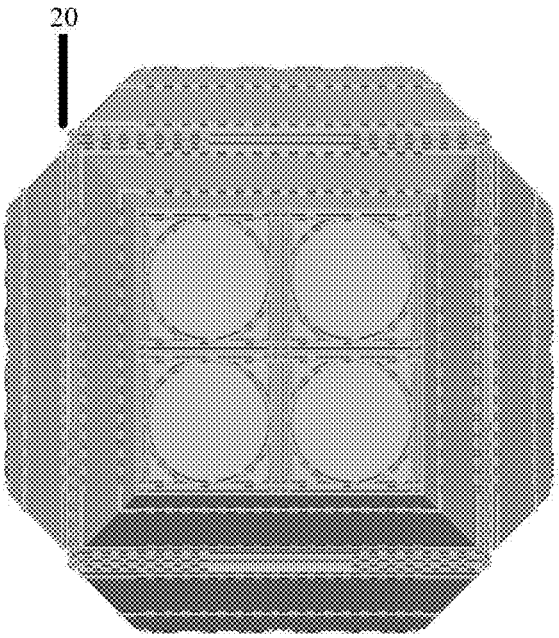
FIG. 40D is a profile view of another side of FIG. 40A.
Figure 41A:
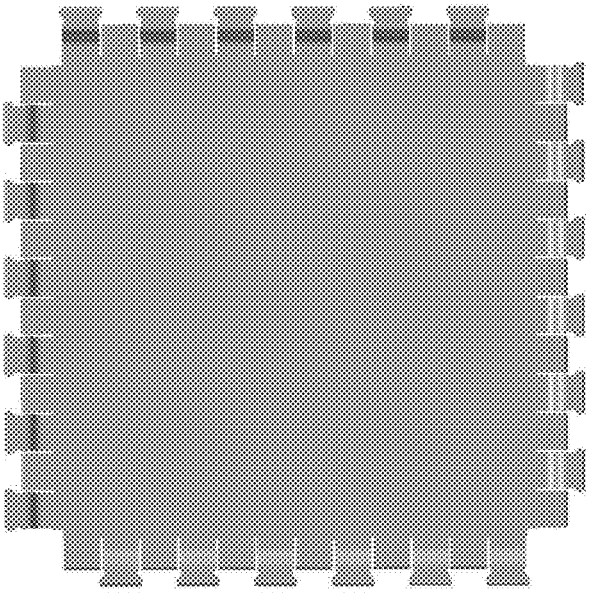
FIG. 41A is a panel that fits snugly into the square "s" snap locations of FIG. 12A.
Figure 41B:
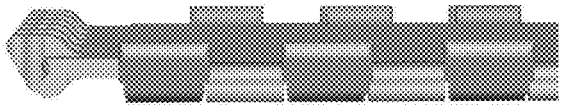
FIG. 41B is a close-up view of an edge of FIG. 41A.
Figure 41C:
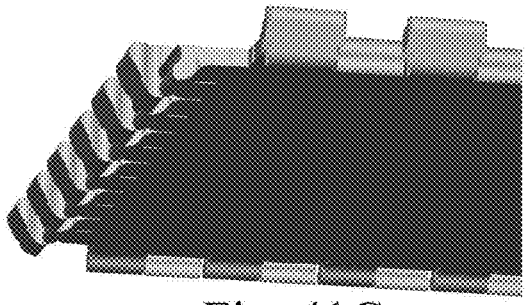
FIG. 41C is a view from the bottom of FIG. 41C.
Figure 41D:
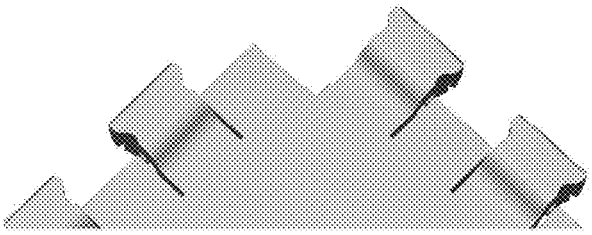
FIG. 41D is a close-up view of a corner of FIG. 41A.

FIG. 39 is a closeup view of how the "s" snaps of FIG. 38 look when the boxes are together.

FIG. 40 is different views of the box that results when two FIG. 38 shapes fit into themselves to form a box. From the view in FIG. 40C there is no bulge at the location identified in element 19. However, the profile view at 90 degrees to that FIG. 40C view, which is shown in FIG. 40D, contains the little bulge identified at element 20.

FIG. 41 is a panel that fits snugly into the square "s" snap locations of FIG. 12.

FIGS. 41A through 41D are different views of the same object.

Figure 42:
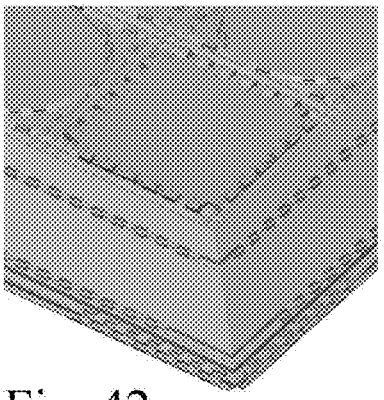
FIG. 42 is a demonstration of how FIG. 41A snaps into FIG. 12A.

FIG. 42 is a demonstration of how FIG. 41 snaps into FIG. 12.

Figure 43A:
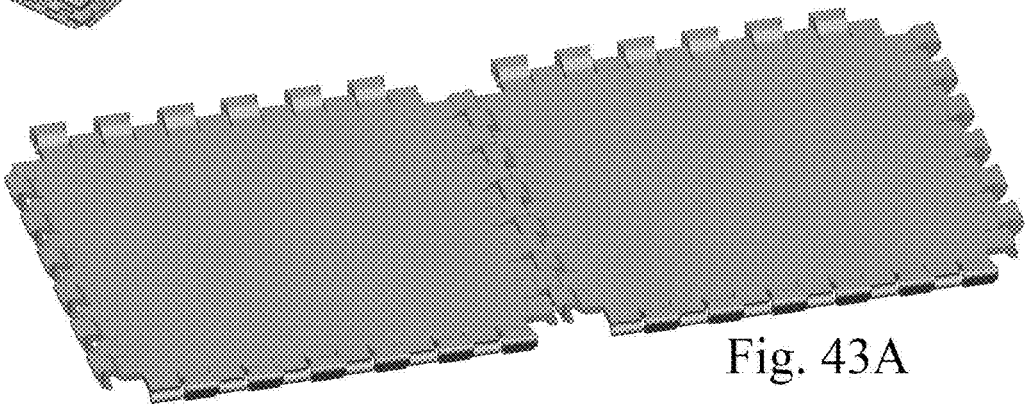
FIG. 43A is an example of how FIG. 41A snaps and hooks into itself horizontally.
Figure 43B:
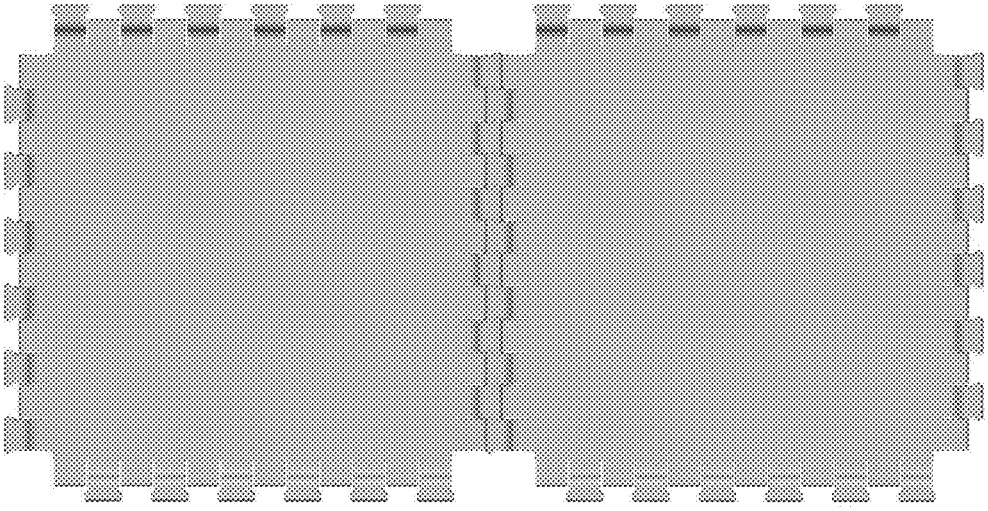
FIG. 43B is a profile view from the top of FIG. 43A.
Figure 43C:
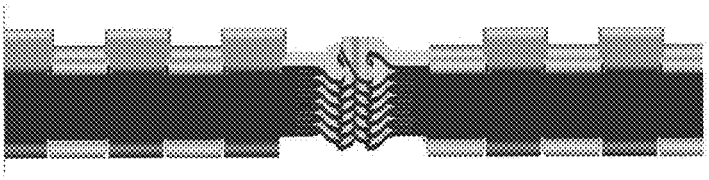
FIG. 43C is a side view of how panels snap together in FIG. 43B.
Figure 44A:
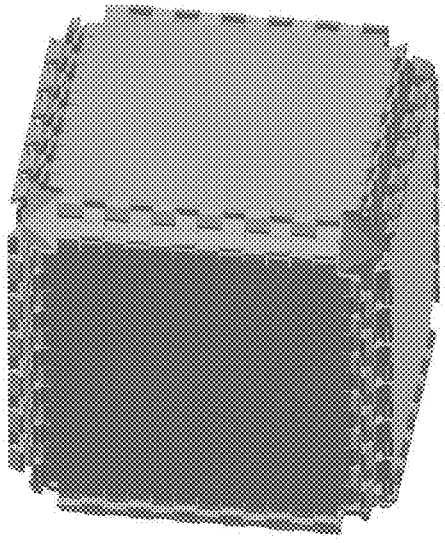
FIG. 44A is an equilateral cube whose sides are similar to the panel that is FIG. 41A.
Figure 44B:
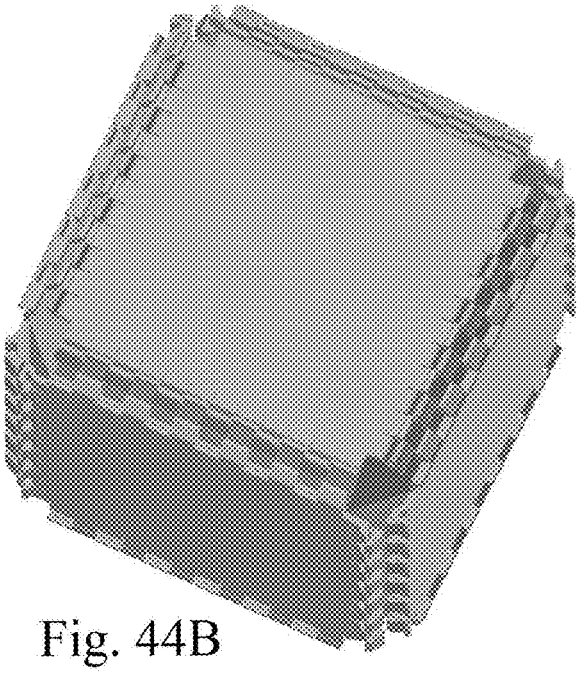
FIG. 44B is a different view of FIG. 44A.
Figure 44C:
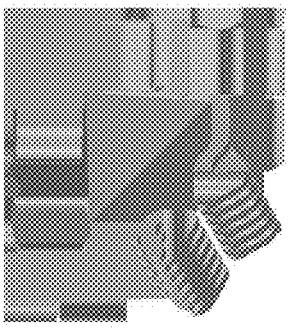
FIG. 44C is a close-up view of an edge of FIG. 44A.
Figure 44D:
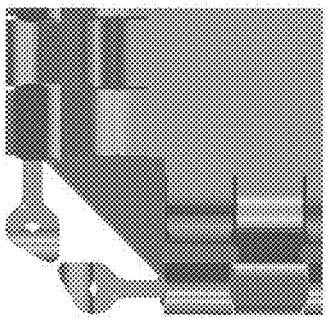
FIG. 44D is a profile close-up view of an edge of FIG. 44A.
Figure 44E:
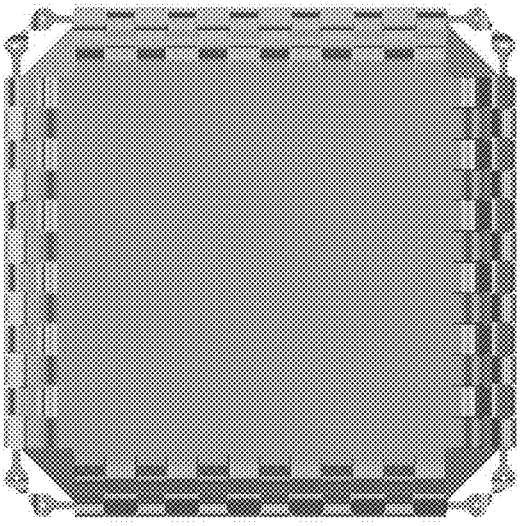
FIG. 44E is a profile view of a side of FIG. 44A.

FIG. 43 is an example of how FIG. 41 snaps and hooks into itself horizontally.

FIG. 44 is an equilateral cube whose sides are similar to the panel that is FIG. 41. FIG. 44 can therefore also fit into FIG. 12 and it can fit into itself and into FIG. 41. FIG. 44E is a profile view of how the sides of FIG. 44 can hook into other cubes and panels.

Figure 45A:
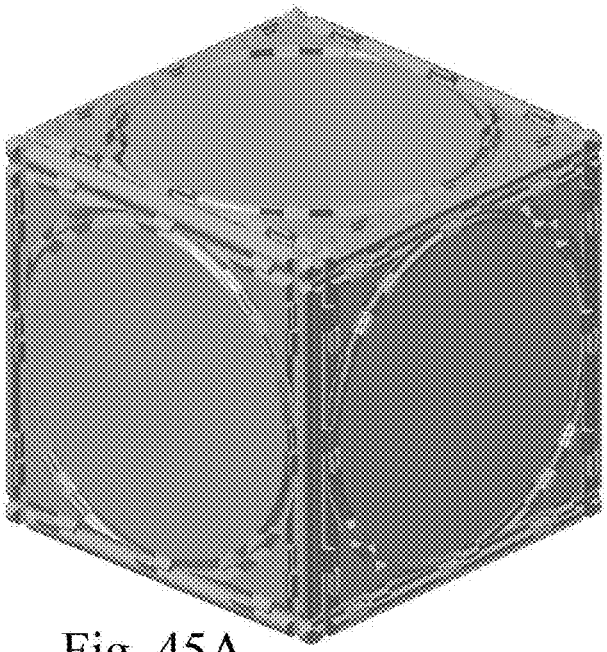
FIG. 45A is a simpler cube the follows the "s" snap logic on FIG. 12A to fit into that box, into itself, and into other pieces in the Invention.
Figure 45B:
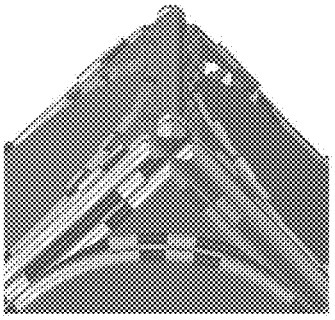
FIG. 45B is a close-up view of a corner of FIG. 45A.
Figure 45C:
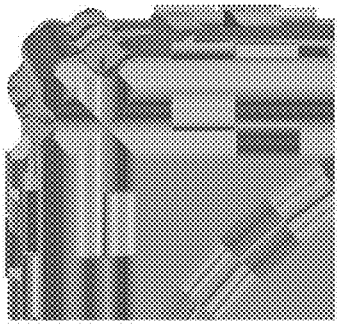
FIG. 45C is a close-up view of an edge of FIG. 45A.

FIG. 45 is a simpler cube the follows the "s" snap logic on FIG. 12 to fit into that box, into itself, and into other pieces in the Invention.

FIGS. 45A, B and C are different views of the same object.

Figure 46A:
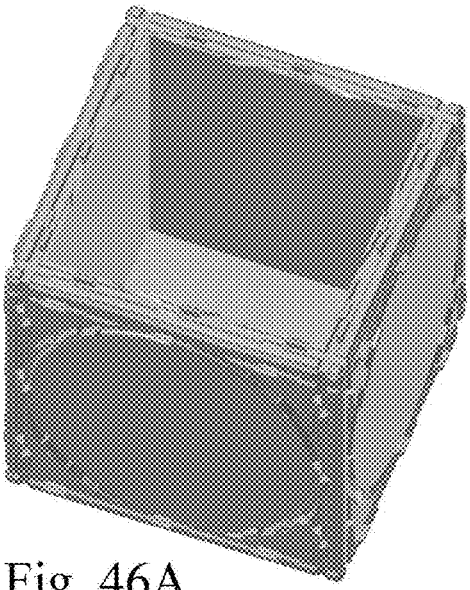
FIG. 46A is the same as FIG. 45A except that one of the sides has been removed to transform it into a box.
Figure 46B:
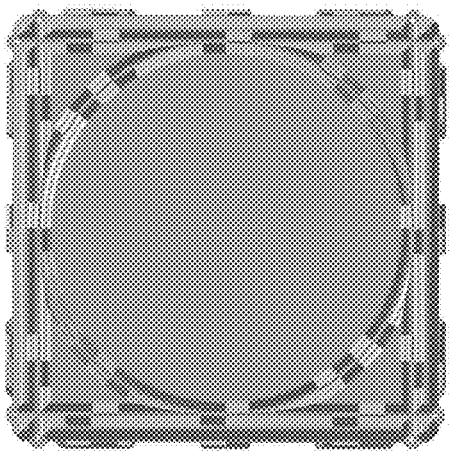
FIG. 46B is a profile view of the bottom of FIG. 46A.
Figure 46C:
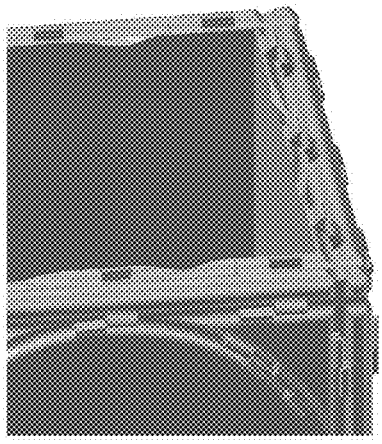
FIG. 46C is a close-up view of a top edge of FIG. 46A.

FIG. 46 is the same as FIG. 45 except that one of the sides has been removed to transform it into a box.

Figure 47A:
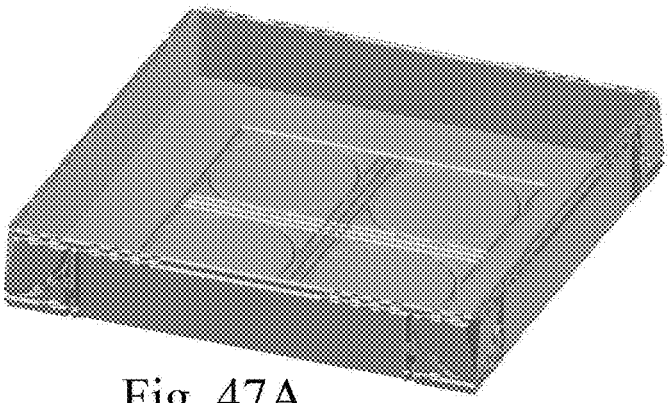
FIG. 47A is a box that fits into FIG. 12A. It is not a fitted box however, in that it cannot fully fit into itself in a "fitted" manner (like a burger box can).
Figure 47B:
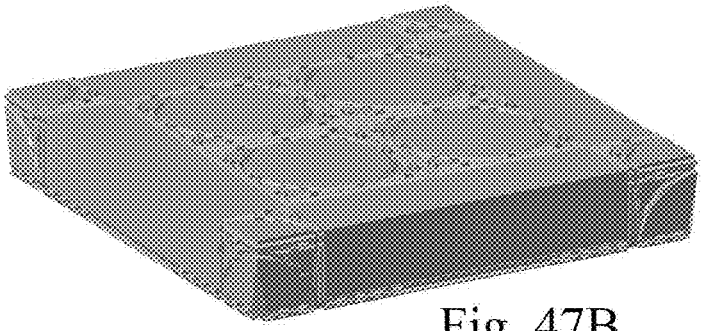
FIG. 47B is the bottom of the box that is FIG. 47A.

FIG. 47 is a box that fits into FIG. 12. It is not a fitted box however, in that it cannot fully fit into itself in a "fitted" manner (like a burger box can). However, it can be stacked and fit into itself along its sides and into the other pieces. FIGS. 47A and 47B are different views of the same object.

Figure 48A:
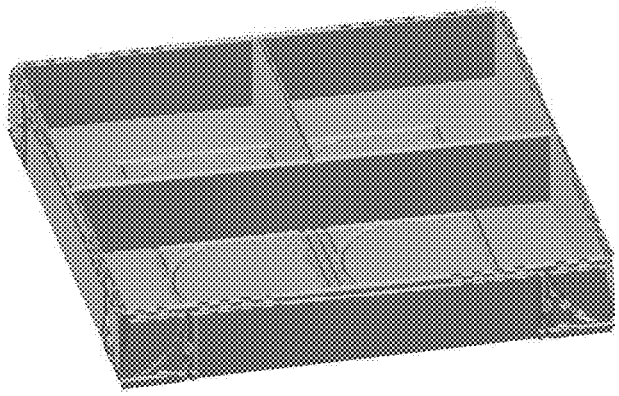
FIG. 48A is the box at FIG. 47A except that it has dividers inside to allow for food or other objects to be kept separate from each other.
Figure 48B:
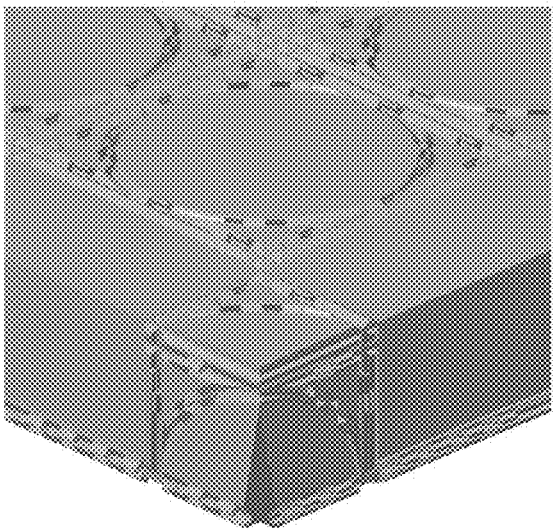
FIG. 48B is a view of a corner of FIG. 48A.
Figure 48C:
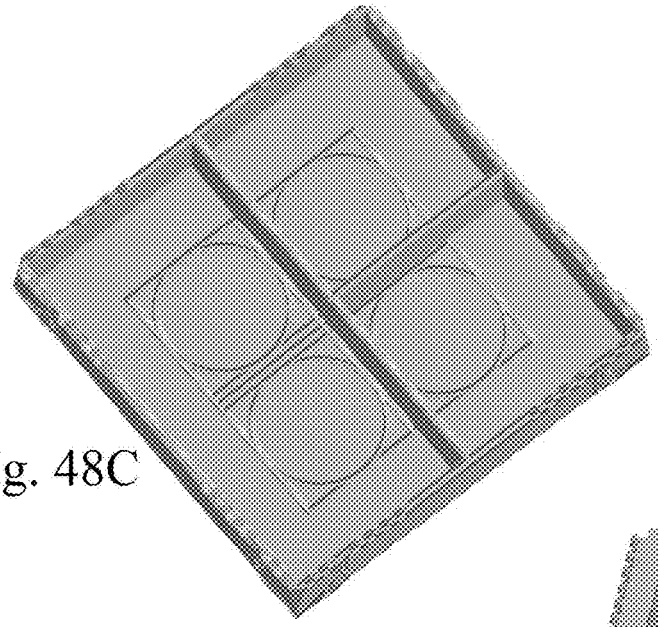
FIG. 48C is a different view of the inside of the box at FIG. 48A.

FIG. 48 is the box at FIG. 47 except that it has dividers inside to allow for food or other objects to be kept separate from each other. This is consistent with how bento boxes are usually built.

Figure 49A:
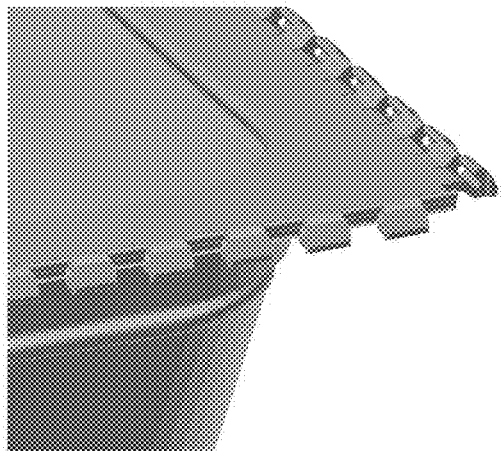
FIG. 49A is a close-up corner of the box at FIG. 49A.
Figure 49B:
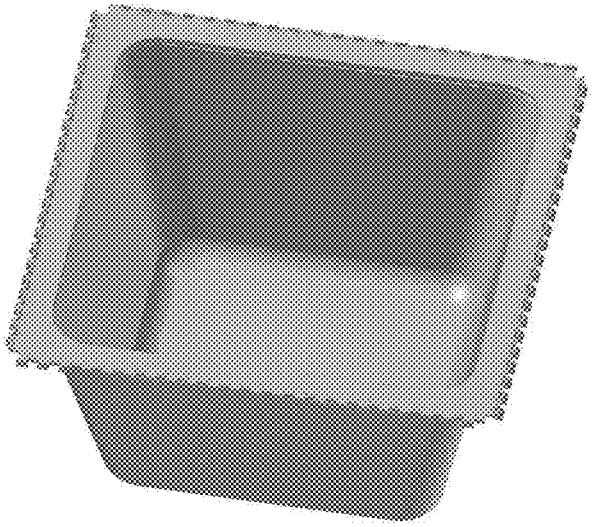
FIG. 49B is a box that is as tall as its opening is wide and deep. It fits into itself when it is stacked in a "fitted" manner by sliding its bottom into the opening of another FIG. 49B piece.
Figure 49C:
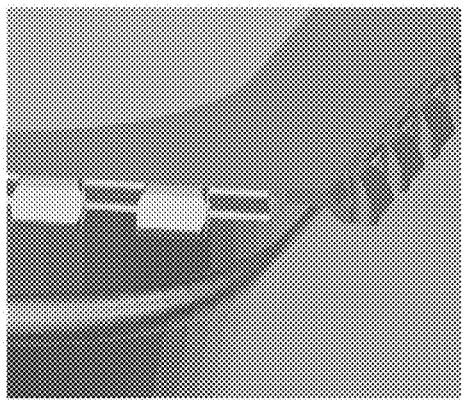
FIG. 49C is a close-up view of a corner of FIG. 49B.
Figure 49D:
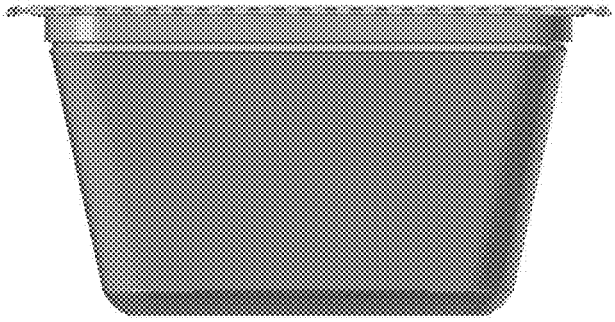
FIG. 49D is a profile side view of FIG. 49B.
Figure 49E:
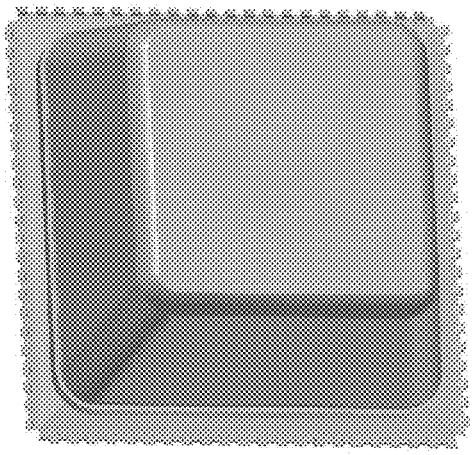
FIG. 49E is a view from the bottom of the box at FIG. 49B.
Figure 49F:
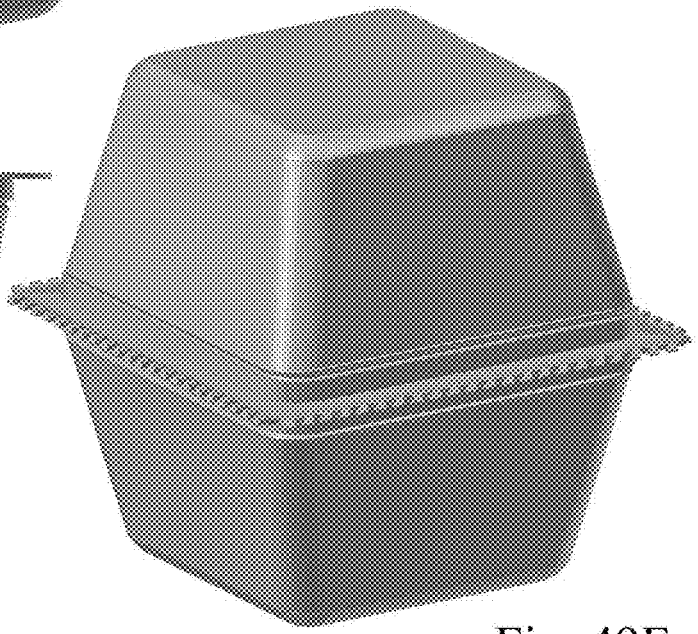
FIG. 49F is an example of how two FIG. 49B pieces fit together.

FIG. 49A through E is a box that is as tall as its opening is wide and deep. It fits into itself when it is stacked in a "fitted" manner by sliding its bottom into the opening of another FIG. 49 piece. It also fits into itself by forming a lid in the manner shown in FIG. 49F, it fits into itself with the "s" snaps on its opening fitting into themselves sideways, and it fits onto the other boxes, including FIG. 48.

Figure 50A:
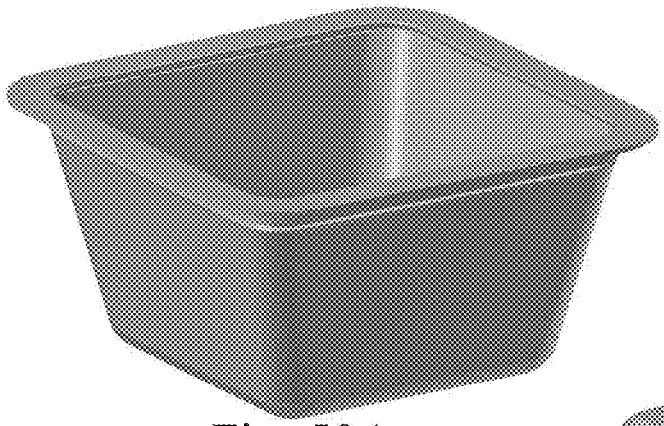
FIG. 50A is a simpler version of FIG. 49B that snaps into itself in a fitted position with the ridge that appears just below the top of the piece in FIG. 50B.
Figure 50B:
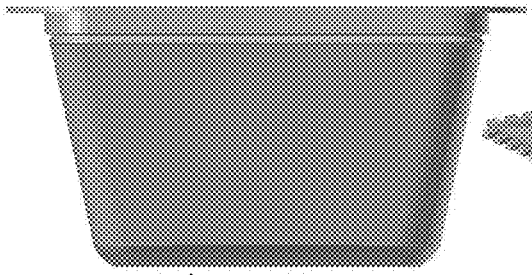
FIG. 50B is a profile view from the side of FIG. 50A.

FIG. 50 is a simpler version of FIG. 49 that snaps into itself in a fitted position with the ridge that appears just below the top of the piece in FIG. 50B.

Figure 51A:
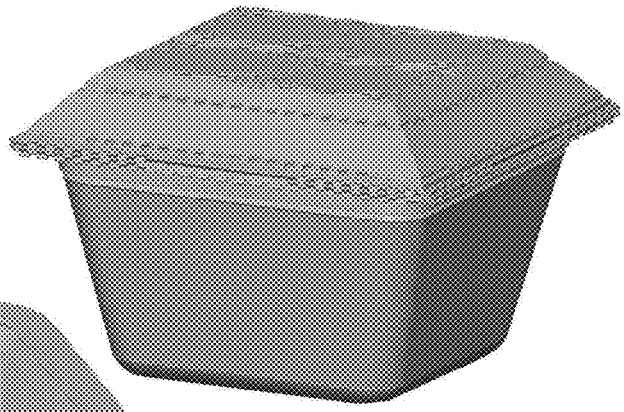
FIG. 51A is an example of how FIG. 12A forms a lid when it fits into FIG. 49B.
Figure 51B:
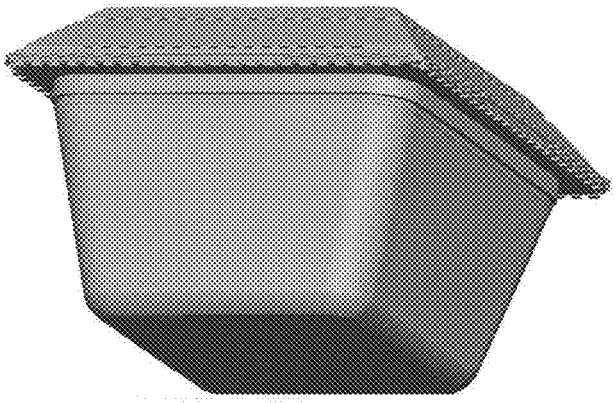
FIG. 51B is a view of FIG. 51A from the bottom.
Figure 53A:
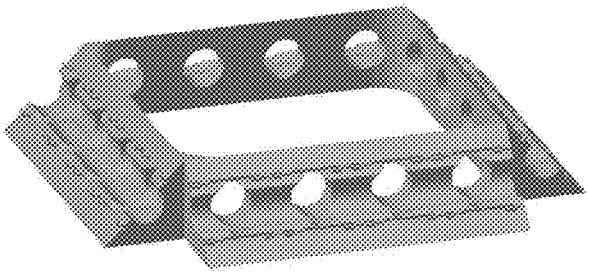
FIG. 53A is a square with slanted sides that have the same basic dimensions as those of the triangle shown at FIGS. 31 through 35. It has reversible "s" snaps at the locations of elements 21, 22, 23, 24 and 25.
Figure 53B:
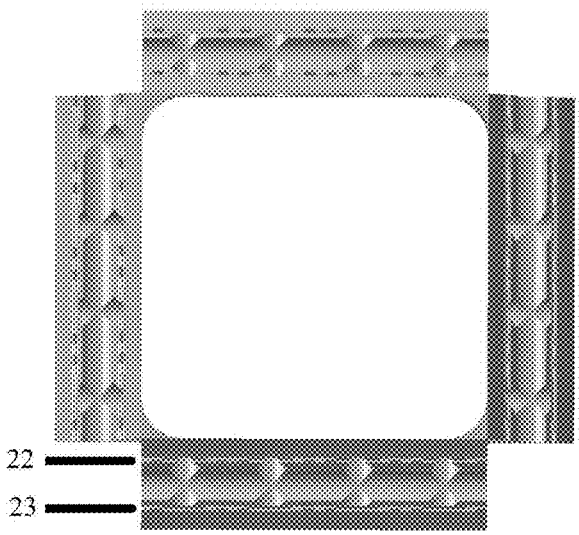
FIG. 53B is a profile view from the top of FIG. 53A.
Figure 53C:
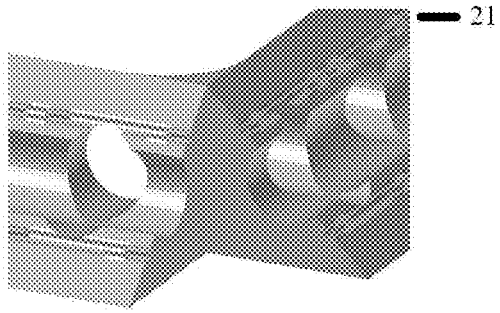
FIG. 53C is a corner view up-close of FIG. 53A 117.
Figure 53D:
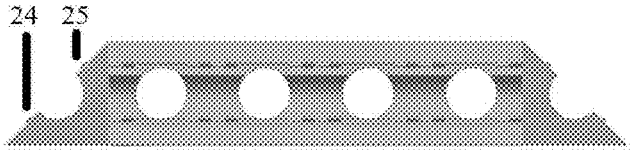
FIG. 53D is a profile view from the side of FIG. 53A.
Figure 54A:
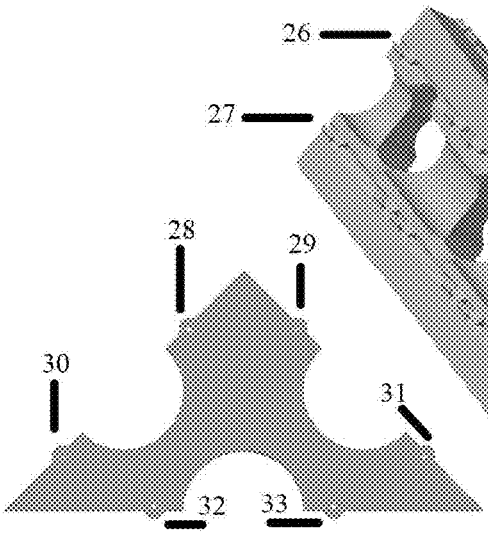
FIG. 54A is a profile view from an end of FIG. 54B.
Figure 54B:
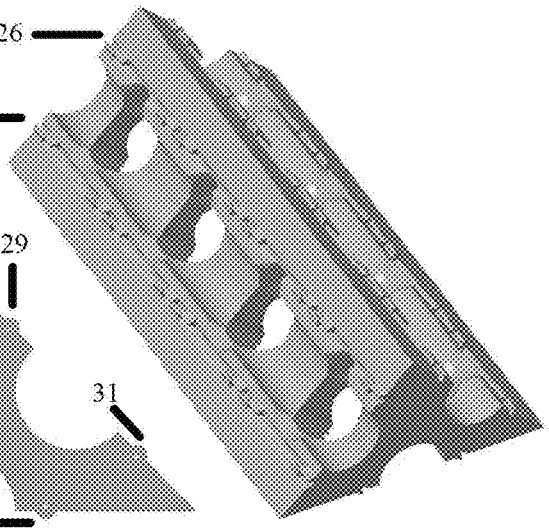
FIG. 54B is the triangle piece that was shown affixed to itself or other pieces in FIGS. 31 through 35. It has reversible "s" snaps at elements Nos. 26 through 33.
Figure 54C:
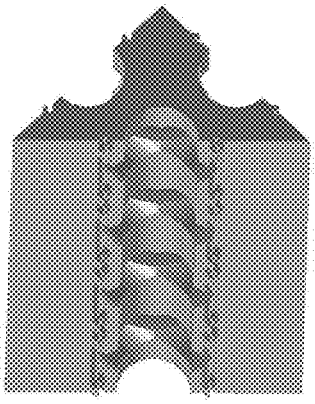
FIG. 54C is a view from the bottom of FIG. 54B.
Figure 54D:
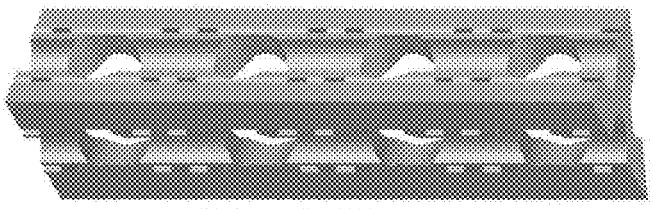
FIG. 54D is a view from the side of FIG. 54B.
Figure 54E:
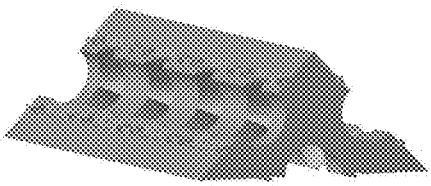
FIG. 54E is a view from a front corner of FIG. 54B.
Figure 54F:
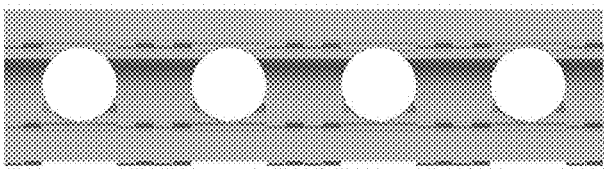
FIG. 54F is a profile side view of FIG. 54B.
Figure 54G:
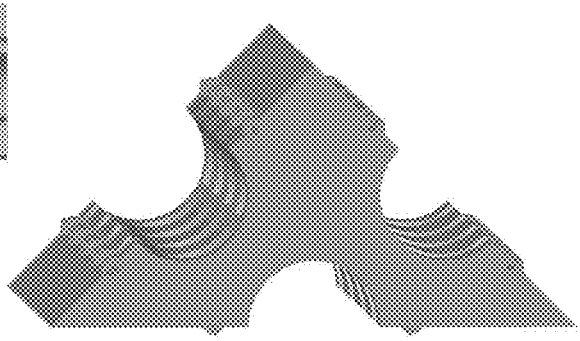
FIG. 54G is a view from an end of FIG. 54B.

FIG. 51 is an example of how FIG. 12 forms a lid when it fits into FIG. 49B.

Figure 52A:
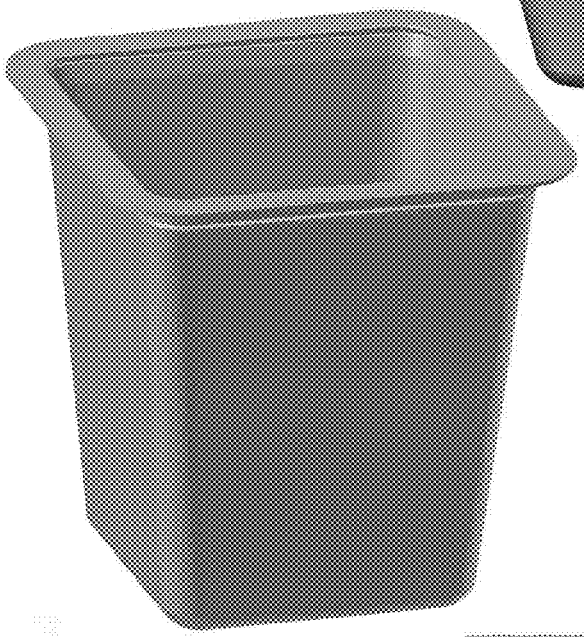
FIG. 52A is similar to FIG. 50A except the box at FIG. 52A is twice as tall as the top is wide or deep.
Figure 52B:
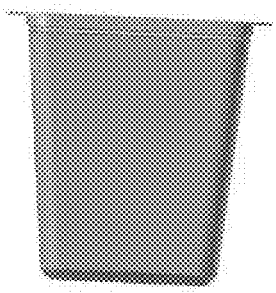
FIG. 52B is a profile view from the side of FIG. 52A.

FIG. 52 is similar to FIG. 50 except the box at FIG. 52 is twice as tall as the top is wide or deep.

FIG. 53 is a square with slanted sides that have the same basic dimensions as those of the triangle shown at FIGS. 31 through 35. It has reversible "s" snaps at the locations of elements 21, 22, 23, 24 and 25.

FIG. 54 is the triangle piece that was shown affixed to itself or other pieces in FIGS. 31 through 35. It has reversible "s" snaps at elements Nos. 26 through 33.

FIG. 55 is a cylinder that also forms a cup holding water. It has "s" snaps on its bottom as shown in FIG. 55A. This cup can be inserted into the burger box and other boxes for storage, to simply transport liquids or it can be used to reinforce those boxes. This cylinder can also fit into itself by snapping its bottom "s" snaps into themselves or by resting its bottom "s" snaps inside the groove of the top opening of the cup shown in FIG. 55B. This cylinder is as tall as it is wide and deep. In other words, it occupies the space of an equilateral cube.

FIG. 56 is the same as FIG. 55 except it is simpler in that it does not have "s" snaps on its bottom.

FIG. 57 is the same as FIG. 55 except it is half as tall.

FIG. 58 fits into circular "s" snaps and stacks onto itself like a paper cup for drinking water.

FIG. 59 is like FIG. 55 except it also has "s" snaps on its sides so it can affix itself to itself horizontally.

FIG. 60 is the same as FIG. 59 except that it has move indentations that give it more versatility to fit inside constructions that have lots of "s" snaps.

FIG. 61 is a simpler version of FIG. 57 that does not include the "s" snaps.

FIG. 62 is a simpler version of FIG. 60 that does not include the "s" snaps.

FIG. 63 is a cup similar to FIG. 60 except that FIG. 63 has a handle that also has "s" snaps on it. The handle sticks out to form a cube in the manner more clearly seen in FIG. 64C (FIG. 64 has an indentation to allow for better grip of the handle; that indentation does not exist on FIG. 63, which is simpler as a result). This handle has reversible snaps that fit into itself, that fit into the "s" snaps on the sides of FIG. 63, and that fit into other cubes and boxes in the Invention.

FIG. 64 is the same as FIG. 63 except that it has an indentation on the side by the handle that makes it easier for a person to insert their fingers to hold the handle.

FIG. 65 is a box with a wavy top that fits into itself to form a larger box that is twice as tall as it is wide and deep.

FIG. 66 is a fitted version of the box at FIG. 65, meaning the box at FIG. 66 can slide into itself and stack itself that way. The wavy tops of FIG. 66 and of FIG. 65 can grab on to the protruding horizontal piece towards the top of FIG. 66.

FIG. 67 is a box similar to FIG. 66 except that the box at FIG. 67 is twice as long as it is deep and tall. The tops of its wavy top identified at element 34 hook on to the side at element 35 when the boxes that are FIG. 67 are stacked in the correct configuration. The female snap is at element 34 and the male snap is at element 35. The patchy male snap on the side of FIG. 67 at element 35 is similar to the solid male snap on FIG. 66.

FIG. 68 is a demonstration of how FIG. 67 snaps into itself when stacked. Element 36 on FIG. 68B is a profile view of the female snap. Element 37 is a profile view of the male and female snaps snapped together when the boxes are stacked in a fitted configuration.

Element 38 is a profile view of the male snap with nothing snapped onto it.

FIG. 69 is a profile view of FIG. 67 stacked in a fitted snapped, and unsnapped, position. At element 39 there is a female snap not snapped onto another box. At element 40, and around the entire box, the female snap of the second box from the top is snapped onto the male snap on the sides of the top box. The male and female snaps of the boxes that meet at element 41 are not engaged, so that the boxes are loosely held together. This is accomplished by simply rotating the box position so that the male snaps do not align with the female snaps. Element 42 is the male snap on the side of the bottom box with nothing affixed to it.

FIG. 70 shows how the wavy tops of the rectangle box FIG. 67 fits into the square boxes that are FIGS. 65 and 66.

FIG. 71 shows how these boxes can be built out to be a construction that is as wide as it is deep and as it is tall, where all the boxes unite in the wavy middle.

FIG. 72 shows how additional boxes can be stacked on top of the construction that is FIG. 71. FIGS. 72A, B and C are different views of the same construction.

FIG. 73 shows how two boxes that are the shape of FIG. 67 fits into themselves when the wavy top rests on itself.

FIG. 74 is a top of the box that is FIG. 67. It has a ridge at the top that operates as a male snap that fits into the boxes' female snaps to snap in place as a lid.

FIG. 75 is a demonstration of how FIG. 74 snaps into FIG. 67 to be a box with its lid on. Another box that is the shape of FIG. 67 can snap on top of FIG. 75 to form the construction that is FIG. 73 in a snapped and stable manner.

FIG. 76 is similar to FIG. 67 except it has holes into which a handle's ends can be placed. Those holes are labeled as elements 43 and 44. That handle also rests inside the top far right side of the box in the view of FIG. 76. In the rested position, the box that is FIG. 76 can be fitted into other boxes just like the box that is FIG. 67 fits into other boxes. The handle can be rotated into an upright position so a person can carry the box that is FIG. 76. Alternatively, the handle can be lifted into a partially upright position that locks the box that is FIG. 76 into another box following the same logic as that shown in FIG. 75.

FIG. 77 is a closer view of the part of FIG. 76 with the hole and the resting place for the box handle.

FIG. 78 is the box handle that can also be a lock in the manner described above.

FIG. 79 shows the handle that is FIG. 78 inserted into the box. The portion of the handle inserted into the box has black outlines on its edges to distinguish it from the rest of the box in FIG. 79.

FIG. 80 is a rectangle box that is twice as long as it is wide. In the middle of the box, in the view shown in FIG. 80C, there are reversible knobs that can hold a divider slat in the middle of the box. They can also hold in place object that have female knobs or reversible make knobs that correspond to the knobs shown in FIG. 80C.

FIG. 80E shows the reversible feet of the box that allow the box to be assembled in the manner shown in FIG. 81.

The indentations and protrusions on the top of the box allow it to be assembled in the manner shown in FIGS. 82, 83 and 84.

All of the interfaces can be placed on the boxes of the invention to enable compact strong and versatile constructions, food storage, and a wide range of additional tasks. Because the shapes, and features within the shapes, all bear a simple and standard relationship with each other (i.e., the pieces are of the same size, twice the length, or twice the height, etc.) they can be easily understood. They can also be used to make, and be compatible with, exponentially larger and smaller constructions. This helps builders make usable larger pieces, while also working with toy-sized interfaces.

The invention claimed is:

1. A building kit system comprising:

a plurality of first, second, third, fourth, and fifth building objects configured to be connected with S-type snap connectors that protrude and recede from a surface or an edge of each object, the snap connector shaped like the letter "S";

the plurality of first building objects comprised of semi-circular shaped objects, the plurality of first building objects further comprising a semi-circular top edge, a semi-circular bottom edge smaller than the top edge, two linear side edges with at least one S-type connector, and a curved body extending between the two semi-circular edges and the two linear side edges, the curved body having at least one of the S-type connectors;

the plurality of second building objects comprised of cube shaped objects, the plurality of second building objects further comprising six square planes with equilateral edges intersecting with each other at ninety-degree angles to form an enclosed cube with at least one S-type connector on the equilateral edges;

the plurality of third building objects comprised of open box shaped objects similar in shape to the cube shaped objects, the plurality of third building objects further comprising five square planes with equilateral edges intersecting with each other at ninety-degree angles to form an open cube with at least one S-type connector on the equilateral edges;

the plurality of fourth building objects comprised of truncated pyramid-shaped box objects, the plurality of fourth building objects further comprising four angled sides connecting at four edges of a rectangular base and extending upward to a smaller, upper, flat rectangular top so as to create a truncated or partial pyramid shape, the four based edges comprising at least one S-type connector;

the plurality of fifth building objects comprised of open cylindrical objects, the plurality of fifth building objects further comprising a circular wall with opposite sides and corresponding circular edges, the wall enclosing a void in a circular fashion to form an open cylinder with an opening on one side, and a solid base on the other side, and at least one S-type connector on the corresponding circular edges;

the plurality of first, second, third, fourth, and fifth building objects assembled in a first configuration such that the plurality of objects are stacked or nested such the occupied space of the assembly is minimized;

the plurality of first, second, third, fourth, and fifth objects assembled in a second configuration such that the plurality of objects are connected along corresponding edges or surfaces by the S-type connectors such that the occupied space of the assembly is maximized;

the plurality of first, second, third, fourth, and fifth objects assembled in a third configuration such that the plurality of objects are both connected along corresponding edges or surfaces by the S-type connectors and stacked or nested such that the occupied space of the assembly is between the maximized and minimized configurations.

* * * * *